US006554407B1

(12) United States Patent
Ikeda et al.

(10) Patent No.: US 6,554,407 B1
(45) Date of Patent: Apr. 29, 2003

(54) INK JET HEAD, METHOD FOR MANUFACTURING INK JET HEAD AND INK JET RECORDER

(75) Inventors: Koji Ikeda, Hyogo (JP); Shigeyuki Takao, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/856,885

(22) PCT Filed: Sep. 20, 2000

(86) PCT No.: PCT/JP00/06457

§ 371 (c)(1),
(2), (4) Date: May 25, 2001

(87) PCT Pub. No.: WO01/23185

PCT Pub. Date: Apr. 5, 2001

(30) Foreign Application Priority Data

Sep. 27, 1999 (JP) ..... 11-272567
Sep. 27, 1999 (JP) ..... 11-272629

(51) Int. Cl.[7] ..... B41J 2/045
(52) U.S. Cl. ..... 347/68
(58) Field of Search ..... 347/68, 69, 70, 347/71

(56) References Cited

U.S. PATENT DOCUMENTS 3,942,030 A * 3/1976 Olsen et al. ..... 347/68
6,232,132 B1 * 5/2001 Yano et al. ..... 438/3
6,390,608 B1 * 5/2002 Mitsuzawa et al. ..... 347/70

FOREIGN PATENT DOCUMENTS

| | | |
|---|---|---|
| EP | 0856895 | 8/1998 |
| EP | 0926747 | 6/1999 |
| JP | 05124188 A | 5/1993 |
| JP | 11-34320 | 2/1999 |
| JP | 2000261059 A | 9/2000 |
| JP | 2000351212 A | 12/2000 |

* cited by examiner

*Primary Examiner*—Anh T. N. Vo
(74) *Attorney, Agent, or Firm*—Harness, Dickey & Pierce, PLC

(57) ABSTRACT

An object is to provide an ink jet head 1 in which dielectric breakdown does not occur even when a defective portion has occurred in a thin film piezoelectric element 18. After a separate electrode 19, the piezoelectric element 18 and a common electrode 17 are sequentially deposited on a substrate, a minute pulse voltage having a larger voltage value and a shorter application duration than a normal application voltage, which is applied for discharging ink, is applied between the separate electrode 19 and the common electrode 17. A discontinuity portion 25 of the common electrode 17 removed by minute dielectric breakdown is covered by an insulative layer 22. A defective portion 24 of the piezoelectric element 18 becomes a no-voltage-application portion where the applied voltage is locally absent.

28 Claims, 27 Drawing Sheets

PRIOR ART

PRIOR ART

INK JET HEAD, METHOD FOR MANUFACTURING INK JET HEAD AND INK JET RECORDER

TECHNICAL FIELD

The present invention relates to an ink jet head, a method for producing an ink jet head, and an ink jet type recording apparatus.

BACKGROUND ART

In the prior art, ink jet type recording apparatuses for recording information by utilizing a piezoelectric effect of a piezoelectric element have been used as printers, word processors, facsimiles, and the like. Typically, an ink jet head for use in a recording apparatus of this type includes a plurality of pressure chambers containing ink, a plurality of nozzles communicated to the pressure chambers, respectively, and an actuator for applying a pressure on the ink in the pressure chamber so as to discharge ink through the nozzle. Some of such actuators are made of a large number of thin films layered together, as illustrated in FIG. 26, for example.

In an ink jet head as described above, a head body 101 is provided with a plurality of pressure chamber depressions 102 arranged in the direction indicated by X1 in the figure. A vibration plate 104 is provided on the head body 101 so as to cover the plurality of pressure chamber depressions 102, so that the vibration plate 104 and the pressure chamber depression 102 of the head body 101 define a pressure chamber 103, A piezoelectric element 105 made of PZT is provided on the vibration plate 104 so as to correspond to each pressure chamber 103, and a separate electrode 106 made of Pt (platinum) is provided on the piezoelectric element 105. Note that the vibration plate 104 is made of Cr (chromium) and functions also as a common electrode of the piezoelectric element 105. The vibration plate 104, the piezoelectric element 105 and the separate electrode 106 together form an actuator. When discharging ink, a voltage is applied between the separate electrode 106 and the vibration plate 104 as a common electrode so as to expand/contract the piezoelectric element 105. Thus, the vibration plate 104 fixed to the piezoelectric element 105 undergoes flexural deformation so as to pressurize the ink in the pressure chamber 103, thereby discharging the ink through a nozzle (not shown).

In recent years, the thickness of the piezoelectric element 105 has been reduced as the ink jet heads have been downsized. However, as the thickness of the piezoelectric element 105 is reduced, the voltage endurance is reduced. Thus, the reduction in the thickness increases the possibility of dielectric breakdown occurring upon application of a voltage. Dielectric breakdown occurring in the piezoelectric element 105 not only reduces the ink discharging performance, but may also leads to leakage of the ink in the pressure chamber 103 to the outside if the degree of dielectric breakdown is high. In view of this, a technique for preventing dielectric breakdown of the piezoelectric element 105 has been longed for in order to improve the reliability of the ink jet head.

As one of such techniques, there is a technique of improving the voltage endurance of the piezoelectric element itself by modifying the crystal structure of a piezoelectric material, as disclosed in Japanese Laid-Open Patent Publication No. 10-217458.

However, during the formation of the piezoelectric element in the process of producing an ink jet head, a defective portion 107 may occur in the piezoelectric element 105 as illustrated in FIG. 27 due to impurities in the production apparatus being introduced into the piezoelectric element or due to the influence of the thermal stress of the piezoelectric element. Therefore, even when the voltage endurance of the material of the piezoelectric element 105 itself is high, the presence of such a defective portion 107 makes the piezoelectric element 105 structurally liable to dielectric breakdown. Specifically, in a case where the defective portion 107 is conductive (e.g., where conductive impurities are introduced), the portion of the piezoelectric element 105 corresponding to the defective portion 107 becomes a portion with a locally reduced thickness, thereby significantly reducing the voltage endurance. Moreover, even in a case where the defective portion 107 is insulative, the piezoelectric element 105 has a non-uniform thickness at the defective portion 107, whereby an electric field localization is likely to occur upon application of a voltage. Therefore, dielectric breakdown is likely to occur in this portion. Particularly, as the thickness of the piezoelectric element is more reduced, the proportion of the defective portion with respect to the piezoelectric element increases. Therefore, the possibility of dielectric breakdown in the piezoelectric element becomes even higher as the thickness of the piezoelectric element is reduced.

Thus, a new technique of preventing the dielectric breakdown of the piezoelectric element in view of the defect which may occur during the formation of the piezoelectric element has been longed for. Moreover, in order to prevent the dielectric breakdown of the piezoelectric element, a new technique of detecting a defect in the piezoelectric element and a new technique of improving the voltage endurance of the piezoelectric element have been longed for.

The present invention has been made in view of the above, and has an object to provide an ink jet head, an ink jet type recording apparatus and a method for producing the same in which the voltage endurance of the piezoelectric element is not reduced even when a defect is included therein.

Moreover, another object is to provide a method for producing an ink jet head in which a defect in the piezoelectric element is detected by a simple method so as to improve the voltage endurance of the piezoelectric element based on the detection. Moreover, another object is to provide an ink jet head and an ink jet type recording apparatus in which the piezoelectric element has a high voltage endurance.

DISCLOSURE OF THE INVENTION

In one embodiment of the present invention, a portion of an upper electrode or a lower electrode corresponding to a defective portion of a piezoelectric element is removed by dielectric breakdown so that an applied voltage is locally absent in the defective portion of the piezoelectric element.

In another embodiment of the present invention, a voltage is applied between an upper electrode and a lower electrode, and a defective portion is detected based on the temperature distribution of the upper electrode or the lower electrode.

In another embodiment of the present invention, a voltage is applied between an upper electrode and a lower electrode to cause minute dielectric breakdown, and a dielectric breakdown portion thereof is detected so as to detect a defective portion.

Specifically, an ink jet head production method according to the present invention is a method for producing an ink jet head for discharging ink by a piezoelectric effect of a piezoelectric element, the method including: a step of, after the piezoelectric element and an upper electrode and a lower electrode of the piezoelectric element are formed, removing, through dielectric breakdown, a portion of the upper electrode or the lower electrode corresponding to a defective portion of the piezoelectric element.

Thus, a portion of the upper electrode or the lower electrode corresponding to the defective portion of the piezoelectric element is removed, whereby at least one of an upper portion or a lower portion overlying/underlying the defective portion of the piezoelectric element becomes an electrode discontinuity portion where the electrode is locally absent. Accordingly, no voltage is applied through the defective portion of the piezoelectric element. Therefore, even if a defect is included in the piezoelectric element, no dielectric breakdown occurs, whereby the voltage endurance of the piezoelectric element does not deteriorate.

The thickness of the piezoelectric element may be 0.5 $\mu$m to 5 $\mu$m.

Thus, the voltage endurance does not deteriorate even though the piezoelectric element is a thin film, whereby the effect of improving the voltage endurance becomes particularly significant.

Another ink jet head production method according to the present invention is an a method for producing an ink jet head, the ink jet head including: a head body which is provided with a plurality of pressure chambers containing ink and a plurality of nozzles communicated to the pressure chambers, respectively; and a plurality of actuators each having a piezoelectric element and a vibration plate for deforming the vibration plate to apply a pressure on the ink in each of the pressure chambers by a piezoelectric effect of the piezoelectric element so as to discharge the ink through each of the nozzles, the method including: a step of depositing a lower electrode on a first base material; a step of depositing a piezoelectric element on the lower electrode; an upper electrode deposition step of depositing an upper electrode on the piezoelectric element; and a dielectric breakdown step of applying a predetermined voltage between the upper electrode and the lower electrode so as to remove, through dielectric breakdown, a portion of the upper electrode corresponding to a defective portion of the piezoelectric element.

Thus, when a defective portion occurs during the formation of the piezoelectric element, the predetermined voltage applied between the upper electrode and the lower electrode causes minute dielectric breakdown of such a degree that the other portions of the piezoelectric element or the upper electrode are not broken, thereby heating the defective portion or a portion of the upper electrode corresponding to the defective portion, with the heat melting and vaporizing a portion of the upper electrode. Therefore, a portion of the upper electrode corresponding to the defective portion of the piezoelectric element is removed easily and smoothly.

The application of the predetermined voltage in the dielectric breakdown step may be performed after patterning the upper electrode.

Thus, as compared to the case where the predetermined voltage is applied before patterning (separating) the electrode, the area of the electrodes at the time of the voltage application is reduced, whereby the amount of charge stored between the electrodes is reduced. Therefore, the current flowing through the defective portion of the piezoelectric element is reduced, whereby the dielectric breakdown can be easily suppressed to a minute degree. Thus, the minute dielectric breakdown for detecting a defective portion can be easily controlled.

The method may include, after the dielectric breakdown step, a step of embedding an insulator in a removed portion of the upper electrode.

Thus, since the portion where dielectric breakdown has occurred is filled up with an insulator, the application of a normal voltage through the defective portion of the piezoelectric element is reliably prevented. Moreover, ink is prevented from entering the portion from a pressure chamber.

Alternatively, the method may include, after the dielectric breakdown step, a step of covering a removed portion of the upper electrode by an insulator.

Thus, since the portion where dielectric breakdown has occurred is covered by an insulator, the application of a normal voltage through the defective portion of the piezoelectric element is reliably prevented. Moreover, ink is prevented from entering the portion from a pressure chamber.

The method may include, after the dielectric breakdown step: an insulative layer formation step of depositing an insulative layer on the upper electrode; a vibration plate deposition step of depositing a vibration plate on the insulative layer; a step of attaching a second base material, which has been provided with a plurality of pressure chamber depressions and nozzles, to the vibration plate so that the pressure chamber depressions are covered by the vibration plate, whereby a plurality of pressure chambers are defined by the pressure chamber depressions and the vibration plate; a step of removing the first base material; and a step of patterning the lower electrode and the piezoelectric element so as to correspond to the respective pressure chambers.

Thus, the portion where dielectric breakdown has occurred is filled up with an insulator or covered by an insulative layer, as described above, whereby the portion becomes a no-voltage-application portion where the applied normal voltage is locally absent. Therefore, since no voltage is applied through the defective portion, the voltage endurance of the piezoelectric element is maintained. Moreover, ink is prevented from entering the portion from a pressure chamber.

The method may include a step of depositing an insulative vibration plate on the upper electrode, instead of the insulative layer formation step and the vibration plate deposition step.

Thus, an ink jet head in which the vibration plate functions also as an insulative layer is obtained.

The method may include, after the dielectric breakdown step: an insulative layer formation step of depositing an insulative layer on the upper electrode; a vibration plate deposition step of depositing a vibration plate on the insulative layer; a step of providing a plurality of pressure chambers and nozzles in the first base material; and a step of patterning the vibration plate so as to correspond to the respective pressure chambers.

Thus, the portion where dielectric breakdown has occurred is filled up with an insulator or covered by an insulative layer, as described above, whereby the portion becomes a no-voltage-application portion where the applied normal voltage is locally absent. Therefore, since no voltage is applied through the defective portion, the voltage endurance of the piezoelectric element is improved. Moreover, ink is prevented from entering the portion from a pressure chamber.

The method may include a step of depositing an insulative vibration plate on the upper electrode, instead of the insulative layer formation step and the vibration plate deposition step.

Thus, an ink jet head in which the vibration plate function also as an insulative layer is obtained.

When the voltage value of the voltage applied in the dielectric breakdown step is set to be larger than the normal voltage, such a degree of dielectric breakdown that would occur when applying the normal voltage will always occur in the dielectric breakdown step. Conversely, if dielectric breakdown does not occur when applying a voltage larger than the normal voltage, dielectric breakdown will not occur when applying the normal voltage. In view of this, the voltage value of the applied voltage is preferably large. However, when the duration for which the application voltage is applied is excessive, the dielectric breakdown may spread out. Therefore, the duration for which the predetermined voltage is applied is preferably short in order to cause dielectric breakdown only in portions where it is required.

In view of this, the predetermined voltage used in the dielectric breakdown step may be a pulse voltage having a larger voltage value and a shorter application duration than a normal pulse voltage, which is applied for deforming the vibration plate for discharging ink.

Thus, the voltage endurance of the piezoelectric element is highly ensured. Moreover, only a portion of the electrode layer corresponding to the defective portion of the piezoelectric layer is removed smoothly.

The thickness of the upper electrode may be less than or equal to the thickness of the lower electrode.

Thus, it is possible to easily remove only the upper electrode without removing the lower electrode for the portion corresponding to the defective portion of the piezoelectric element, thereby facilitating the subsequent repairing of the removed portion.

Another ink jet head production method according to the present invention is a method for producing an ink jet head, the ink jet head including: a head body which is provided with a plurality of pressure chambers containing ink and a plurality of nozzles communicated to the pressure chambers, respectively; and a plurality of actuators each having a piezoelectric element and a vibration plate for deforming the vibration plate to apply a pressure on the ink in each of the pressure chambers by a piezoelectric effect of the piezoelectric element so as to discharge the ink through each of the nozzles, the method including: a step of depositing a lower electrode on a first base material; a step of depositing a piezoelectric element on the lower electrode; a step of depositing a conductive vibration plate on the piezoelectric element; a dielectric breakdown step of applying a predetermined voltage between the conductive vibration plate and the lower electrode so as to remove, through dielectric breakdown, a portion of the conductive vibration plate corresponding to a defective portion of the piezoelectric element; a step of depositing an insulative layer on the conductive vibration plate; a step of attaching a second base material, which has been provided with a plurality of pressure chamber depressions and nozzles, to the insulative layer so that the pressure chamber depressions are covered by the insulative layer, whereby a plurality of pressure chambers are defined by the pressure chamber depressions and the insulative layer; a step of removing the first base material; and a step of patterning the lower electrode and the piezoelectric element so as to correspond to the respective pressure chambers.

Thus, since the vibration plate is conductive, the vibration plate functions also as the upper electrode. Therefore, it is no longer necessary to separately provide the vibration plate and the upper electrode. Moreover, the portion where dielectric breakdown has occurred is filled up with an insulator or covered by an insulative layer, as described above, whereby the portion becomes a no-voltage-application portion where the applied normal voltage is locally absent, thus improving the voltage endurance of the piezoelectric element.

The application of the predetermined voltage in the dielectric breakdown step may be performed after patterning the conductive vibration plate.

Thus, as compared to the case where the predetermined voltage is applied before patterning (separating) the electrode, the area of the electrodes at the time of the voltage application is reduced, whereby the amount of charge stored between the electrodes is reduced. Therefore, the current flowing through the defective portion of the piezoelectric element is reduced, whereby the dielectric breakdown can be easily suppressed to a minute degree. Thus, the minute dielectric breakdown for detecting a defective portion can be easily controlled.

Another ink jet head production method according to the present invention is a method for producing an ink jet head, the ink jet head including: a head body which is provided with a plurality of pressure chambers containing ink and a plurality of nozzles communicated to the pressure chambers, respectively; and a plurality of actuators each having a piezoelectric element and a vibration plate for deforming the vibration plate to apply a pressure on the ink in each of the pressure chambers by a piezoelectric effect of the piezoelectric element so as to discharge the ink through each of the nozzles, the method including: a step of depositing a lower electrode on a first base material; a step of depositing a piezoelectric element on the lower electrode; a step of depositing a conductive vibration plate on the piezoelectric element; a dielectric breakdown step of applying a predetermined voltage between the conductive vibration plate and the lower electrode so as to remove, through dielectric breakdown, a portion of the conductive vibration plate corresponding to a defective portion of the piezoelectric element; a step of depositing an insulative layer on the conductive vibration plate; a step of providing a plurality of pressure chambers and nozzles in the first base material; and a step of patterning the conductive vibration plate and the insulative layer so as to correspond to the respective pressure chambers.

Thus, since the vibration plate is conductive, the vibration plate functions also as the upper electrode, as described above. Therefore, it is no longer necessary to separately provide the vibration plate and the upper electrode. Moreover, the portion where dielectric breakdown has occurred is filled up with an insulator or covered by an insulative layer, as described above, whereby the portion becomes a no-voltage-application portion where the applied normal voltage is locally absent, thus improving the voltage endurance of the piezoelectric element.

The application of the predetermined voltage in the dielectric breakdown step may be performed after patterning the conductive vibration plate.

Thus, as compared to the case where the predetermined voltage is applied before patterning (separating) the electrode, the area of the electrodes at the time of the voltage application is reduced, whereby the amount of charge stored between the electrodes is reduced. Therefore, the current flowing through the defective portion of the piezoelectric element is reduced, whereby the dielectric breakdown can be easily suppressed to a minute degree. Thus, the minute dielectric breakdown for detecting a defective portion can be easily controlled.

An ink jet head according to the present invention is an ink jet head for discharging ink by a piezoelectric effect of a piezoelectric element, wherein: a first electrode and a second electrode for applying a voltage through the piezoelectric element are provided respectively on opposite sides of the piezoelectric element; and a discontinuity portion is formed through dielectric breakdown in at least one of the first and second electrodes.

Thus, no voltage is applied through the defective portion of the piezoelectric element, whereby an ink jet head having a piezoelectric element with a desirable voltage endurance is obtained.

An insulator may be embedded in the discontinuity portion of the first or second electrode.

Thus, the discontinuity portion is filled up with an insulator, whereby the application of a normal voltage through the defective portion of the piezoelectric element is reliably prevented.

The discontinuity portion of the first or second electrode may be covered by an insulator.

Thus, the discontinuity portion is covered by an insulator, whereby the application of a normal voltage through the defective portion of the piezoelectric element is reliably prevented.

The thickness of the piezoelectric element may be 0.5 $\mu$m to 5 $\mu$m.

Thus, the voltage endurance does not deteriorate even though the piezoelectric element is a thin film, whereby the effect of improving the voltage endurance becomes particularly significant.

Another ink jet head according to the present invention is an ink jet head ink jet head for discharging ink by a piezoelectric effect of a piezoelectric element, wherein: a first electrode and a second electrode for applying a voltage through the piezoelectric element are provided respectively on opposite sides of the piezoelectric element; a thickness of the first electrode is less than or equal to a thickness of the second electrode; and a discontinuity portion is formed through dielectric breakdown in the first electrode.

Thus, no voltage is applied through the defective portion of the piezoelectric element, whereby an ink jet head having a piezoelectric element with a desirable voltage endurance is obtained.

The thickness of the piezoelectric element may be 0.5 $\mu$m to 5 $\mu$m.

Thus, the voltage endurance does not deteriorate even though the piezoelectric element is a thin film, whereby the effect of improving the voltage endurance becomes particularly significant.

Another ink jet head production method according to the present invention is a method for producing an ink jet head for discharging ink by a piezoelectric effect of a piezoelectric element, the method including: a step of, after the piezoelectric element and an upper electrode and a lower electrode of the piezoelectric element are formed, detecting a temperature distribution of at least one of the upper electrode and the lower electrode while applying a predetermined voltage between the upper electrode and the lower electrode so as to detect a defective portion of the piezoelectric element based on the temperature distribution.

Thus, when a voltage is applied between the upper electrode and the lower electrode, if a defect is included in the piezoelectric element, minute dielectric breakdown occurs in the defective portion, thereby heating the piezoelectric element. Therefore, it is possible to find the defective portion of the piezoelectric element by detecting the portion whose temperature takes an extreme value (the maximum value or the minimum value).

The temperature of the upper electrode or the lower electrode may be measured by temperature detection means for periodically detecting a temperature; and a plurality of pulse voltages may be applied, as the predetermined voltage, at a cycle less than or equal to the detection cycle of the temperature detection means.

Thus, when a plurality of pulse voltages are applied as the predetermined voltage, unlike the case where a constant voltage is applied for a long time, excessive heating of the upper electrode or the lower electrode is prevented. Moreover, when the cycle of the plurality of pulse voltages is excessively long, the temperature distribution created by the voltage application is leveled out, thereby making the detection of the defective portion difficult. However, according to the above, the cycle of the pulse voltages is less than or equal to the detection cycle of the temperature detection means, whereby it is easy to detect the defective portion.

Each of the pulse voltages may be a pulse voltage having a larger voltage value and a shorter application duration than a normal pulse voltage, which is applied for discharging ink.

Thus, when the voltage value of the pulse voltages is set to be larger than voltage value of the normal pulse voltage, such a degree of dielectric breakdown that would occur when applying the normal pulse voltage will always occur when applying the pulse voltages. Conversely, if dielectric breakdown does not occur by the application of the pulse voltages, dielectric breakdown will not occur when applying the normal pulse voltage. Therefore, the voltage endurance of the piezoelectric element is highly ensured. Moreover, since the duration for which each pulse voltage is applied is shorter than the duration for which the normal pulse voltage is applied, excessive heating of the upper electrode or the lower electrode is prevented, and breakdown of an electrode due to heating is unlikely to occur.

The temperature of the upper electrode or the lower electrode may be detected by temperature detection means for detecting a temperature by elements each having a predetermined size; and the method may include a step of, after an extreme value element for which the detected temperature is maximum or minimum is identified among a plurality of elements, identifying a peak temperature portion within the extreme value element based on a temperature distribution among a plurality of adjacent elements which are adjacent to the extreme value element.

Thus, first, the temperature distribution of the upper electrode or the lower electrode is detected by the temperature detection means having a predetermined resolution in the unit of elements according to the resolution. Then, the temperature of each of the plurality of elements is detected, and the element for which the detected temperature is higher than that of any of the adjacent elements or the element for which the detected temperature is lower than that of any of the adjacent elements is identified as the extreme value element. Then, the temperature distribution within the extreme value element is estimated by interpolation, or the like, based on the temperature distribution among the plurality of adjacent elements which are adjacent to the extreme value element, and a portion where the temperature takes the maximum value or the minimum value within the extreme value element (the peak temperature portion) is identified. Therefore, it is possible to detect the temperature distribution at a resolution equal to or greater than the inherent resolution of the temperature detection means, and to detect a very small defective portion.

The method may include a step of, after a defective portion of the piezoelectric element is detected, removing a portion of the upper electrode or the lower electrode corresponding to the defective portion or a portion of the upper electrode or the lower electrode corresponding to a surrounding portion around the defective portion.

Thus, a portion of the upper electrode or the lower electrode corresponding to the defective portion becomes a discontinuity portion where the electrode is locally absent or an isolated portion which is isolated from the other electrode portions, whereby no voltage is applied through the defective portion of the piezoelectric element during the ink discharging operation. Therefore, dielectric breakdown is unlikely to occur, thereby improving the voltage endurance of the piezoelectric element.

The method may include a step of embedding an insulator in a removed portion of the upper electrode or the lower electrode.

Thus, the portion where dielectric breakdown has occurred is filled up with an insulator, whereby the application of a voltage through the portion is reliably prevented.

The method may include a step of covering a removed portion of the upper electrode or the lower electrode by an insulator.

Thus, the portion where dielectric breakdown has occurred is covered by an insulator, whereby the application of a voltage through the portion is reliably prevented.

The application of the predetermined voltage may be performed after patterning at least one of the upper electrode and the lower electrode.

Thus, as compared to the case where the predetermined voltage is applied before patterning (separating) the electrode, the area of the electrodes at the time of the voltage application is reduced, whereby the amount of charge stored between the electrodes is reduced. Therefore, the current flowing through the defective portion of the piezoelectric element is reduced, whereby the dielectric breakdown can be easily suppressed to a minute degree. Thus, the minute dielectric breakdown for detecting a defective portion can be easily controlled.

Another ink jet head production method according to the present invention is a method for producing an ink jet head for discharging ink by a piezoelectric effect of a piezoelectric element, the method including: a step of, after the piezoelectric element and an upper electrode and a lower electrode of the piezoelectric element are formed, applying a predetermined voltage between the upper electrode and the lower electrode and detecting a dielectric breakdown portion in the upper electrode or the lower electrode which has been created due to the voltage application so as to detect a defective portion of the piezoelectric element.

Thus, when a minute voltage is applied between the upper electrode and the lower electrode, if a defect has occurred in the piezoelectric element, minute dielectric breakdown occurs in the portion. As a result, a portion of the upper electrode or the lower electrode corresponding to the defective portion of the piezoelectric element is scattered away, thereby forming a discontinuity portion in the upper electrode or the lower electrode. Then, the defect of the piezoelectric element is detected by detecting the discontinuity portion with a microscope, or the like.

The method may include a step of, after a defective portion of the piezoelectric element is detected, removing a portion of the upper electrode or the lower electrode corresponding to the defective portion or a portion of the upper electrode or the lower electrode corresponding to a surrounding portion around the defective portion.

Thus, a portion of the upper electrode or the lower electrode corresponding to the defective portion becomes a discontinuity portion where the electrode is locally absent or an isolated portion which is isolated from the other electrode portions, whereby no voltage is applied through the defective portion of the piezoelectric element during the ink discharging operation. Therefore, dielectric breakdown is unlikely to occur, thereby improving the voltage endurance of the piezoelectric element.

The method may include a step of embedding an insulator in a removed portion of the upper electrode or the lower electrode.

Thus, the portion where dielectric breakdown has occurred is filled up with an insulator, whereby the application of a voltage through the portion is reliably prevented.

The method may include a step of covering a removed portion of the upper electrode or the lower electrode by an insulator.

Thus, the portion where dielectric breakdown has occurred is covered by an insulator, whereby the application of a voltage through the portion is reliably prevented.

The application of the predetermined voltage may be performed after patterning at least one of the upper electrode and the lower electrode.

Thus, as compared to the case where the predetermined voltage is applied before patterning (separating) the electrode, the area of the electrodes at the time of the voltage application is reduced, whereby the amount of charge stored between the electrodes is reduced. Therefore, the current flowing through the defective portion of the piezoelectric element is reduced, whereby the dielectric breakdown can be easily suppressed to a minute degree. Thus, the minute dielectric breakdown for detecting a defective portion can be easily controlled.

Another ink jet head according to the present invention is an ink jet head ink jet head for discharging ink by a piezoelectric effect of a piezoelectric element, wherein: a first electrode and a second electrode for applying a voltage through the piezoelectric element are provided respectively on opposite sides of the piezoelectric element; and a discontinuity portion is formed in at least one of the first and second electrodes, the discontinuity portion being provided by removing a portion corresponding to a defective portion of the piezoelectric element or a portion corresponding to a surrounding portion around the defective portion.

Thus, a portion of an electrode on one side or both sides of the piezoelectric element corresponding to the defective portion is removed, whereby an ink jet head having a piezoelectric element with a desirable voltage endurance is obtained.

An insulator may be embedded in a discontinuity portion of the first or second electrode.

Thus, the application of a voltage through the it defective portion of the piezoelectric element is reliably prevented, thereby improving the voltage endurance of the piezoelectric element.

A discontinuity portion of the first or second electrode may covered by an insulator.

Thus, the application of a voltage through the defective portion of the piezoelectric element is reliably prevented, thereby improving the voltage endurance of the piezoelectric element.

An ink jet type recording apparatus according to the present invention includes any of the ink jet head described above.

Thus, a reliable ink jet type recording apparatus having a piezoelectric element with a desirable voltage endurance is obtained.

As described above, according to the present invention, minute dielectric breakdown is caused in a defective portion of a piezoelectric element during the head production process so as to remove beforehand a portion of the upper electrode or the lower electrode overlying/underlying the piezoelectric element corresponding to the defective portion, whereby the defective portion of the piezoelectric element can be a no-voltage-application portion where the applied voltage is locally absent. Therefore, even if a defective portion is included in the piezoelectric element, no voltage is applied through the defective portion during the application of a normal voltage, whereby it is possible to prevent dielectric breakdown from occurring. Therefore, even when the thickness of the piezoelectric element is reduced, the voltage endurance thereof can be desirably maintained.

By filling up the discontinuity portion of the upper electrode or the lower electrode with an insulator, or by covering the discontinuity portion by an insulator, the voltage endurance of the piezoelectric element can be further improved. Moreover, ink is prevented from entering the defective portion.

Moreover, according to the present invention, the defective portion of the piezoelectric element can be easily detected. Therefore, it is possible to increase the voltage endurance of the piezoelectric element by subsequently removing or repairing the defective portion.

With an ink jet head and an ink jet type recording apparatus according to the present invention, no voltage is applied through a defective portion of a piezoelectric element, whereby no dielectric breakdown occurs. Therefore, an ink jet head and an ink jet type recording apparatus having a piezoelectric element with a desirable voltage endurance can be obtained.

BEST MODE FOR CARRYING OUT THE INVENTION

Embodiments of the present invention will now be described with reference to the drawings.

Embodiment 1

Configuration of Ink Jet Head

Figure 1:
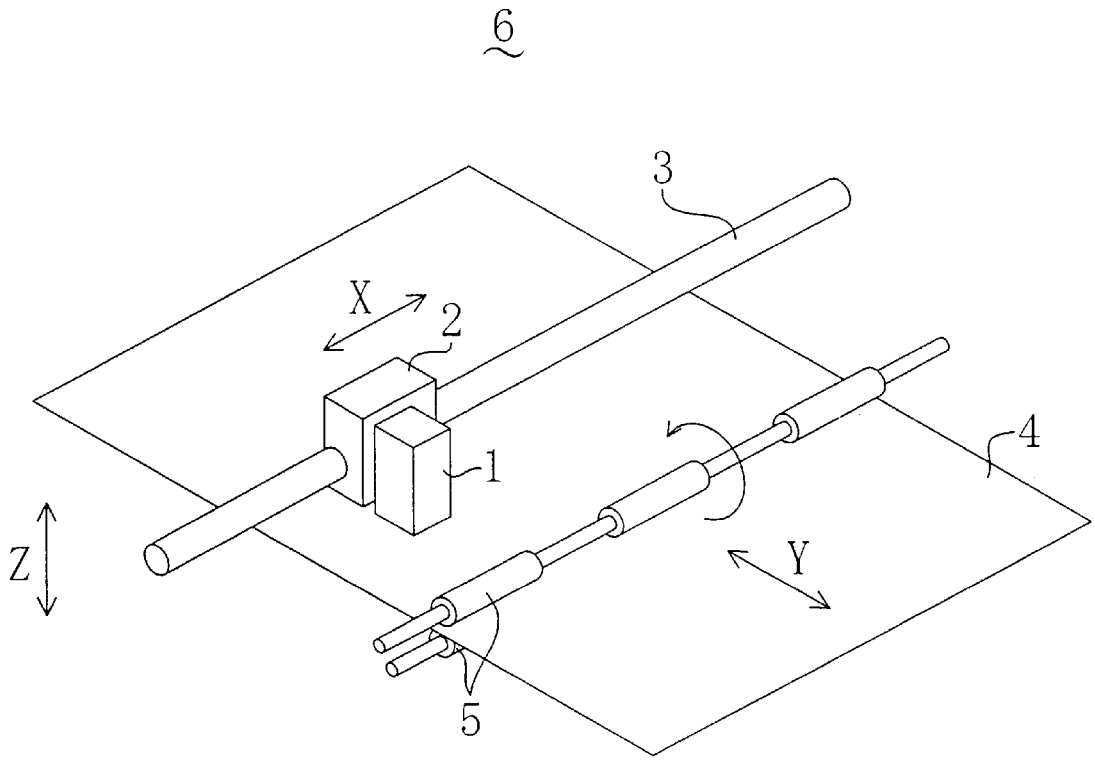
FIG. 1 is a schematic diagram illustrating a configuration of an ink jet printer.

As illustrated in FIG. 1, an ink jet head 1 according to one embodiment is incorporated in an ink jet printer 6 as an ink jet type recording apparatus for recording information by discharging ink droplets so that they strike a recording medium 4 such as paper. The ink jet head 1 is mounted on a carriage 2, which is reciprocated along a carriage shaft 3, so as to be reciprocated together with the carriage 2 in the primary scanning direction (the X direction as shown in the figure). Rollers 5 are configured so as to move the recording medium 4 in the secondary scanning direction (the Y direction as shown in the figure) each time the carriage 2 moves in the primary scanning direction for one scanning operation.

Figure 2:
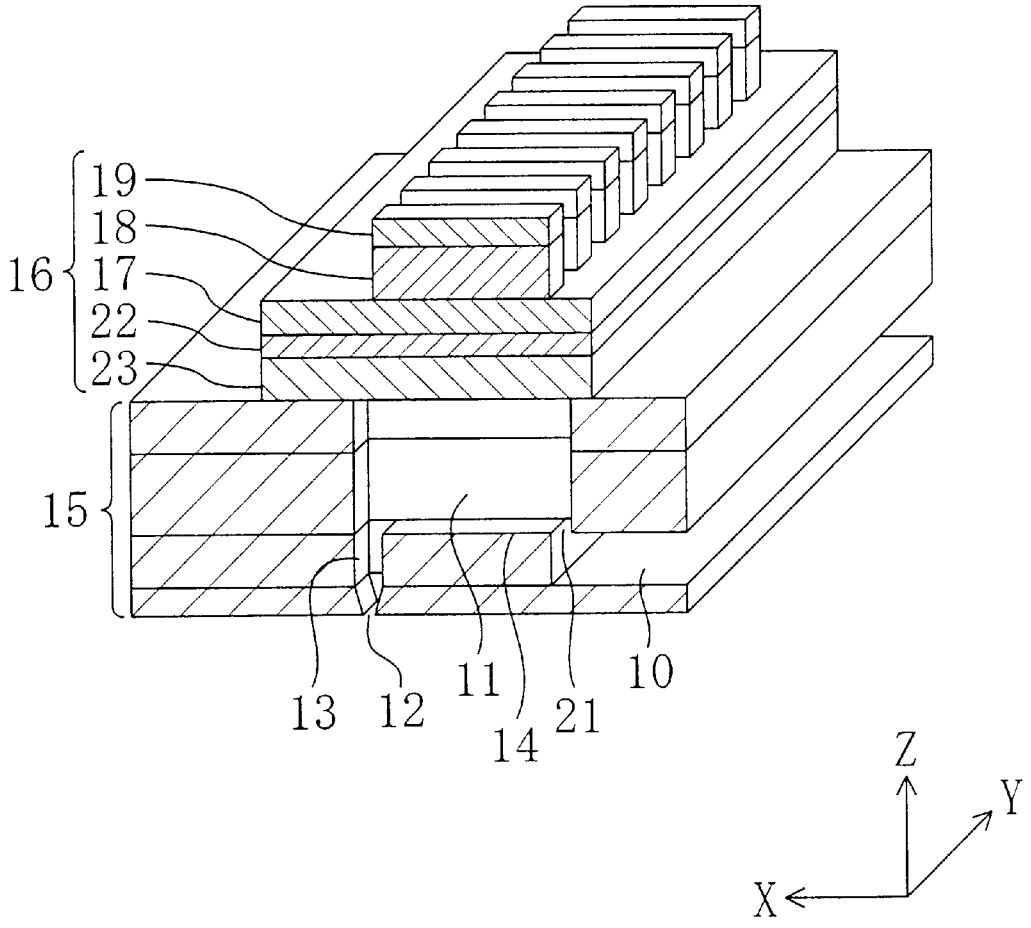
FIG. 2 is a perspective view illustrating an ink jet head.

As illustrated in FIG. 2, the ink jet head 1 includes a head body 15 which is provided with a common ink chamber 10, a plurality of pressure chamber depressions 14 and a plurality of nozzles 12, and an actuator section 16 for applying a pressure on the ink in a pressure chamber 11.

The pressure chamber depressions 14 of the head body 15 are arranged in the secondary scanning direction at predetermined intervals. Each pressure chamber depression 14 is shaped in a generally rectangular shape whose opening cross section (X-Y cross-section) is elongated in the primary scanning direction. An ink supply port 21 for connecting the common ink chamber 10 to the pressure chamber 11 is formed at one longitudinal end (the right end in FIG. 2) of the bottom portion of the pressure chamber depression 14, and an ink channel 13 connecting the pressure chamber 11 to the nozzle 12 is formed at the other end (the left end in FIG. 2).

The actuator section 16 includes a vibration plate 23 made of chromium (Cr) and having a thickness of 4 μm which covers the pressure chamber depression 14 of the head body 15, an insulative layer 22 having a thickness of 0.5 μm which is formed on the vibration plate 23, a common electrode 17 made of platinum (Pt) and having a thickness of 0.1 μm to 0.2 μm which is formed on the insulative layer 22, piezoelectric elements 18 made of a thin PZT film and having a thickness of 3 μm which are formed on the common electrode 17, separate electrodes 19 made of platinum and having a thickness of 0.1 μm which are formed on the piezoelectric elements 18, and an insulative layer (not shown in FIG. 1 to FIG. 3) made of polyimide which fills up the gap between adjacent ones of the piezoelectric elements 18 and the separate electrodes 19. Note that in each figure, the various components of the actuator section 16 are shown to a scale that is different from the actual scale for ease of understanding. The piezoelectric elements 18 and the separate electrodes 19 are provided at positions respectively corresponding to the pressure chamber depressions 14 of the head body 15.

Figure 3:
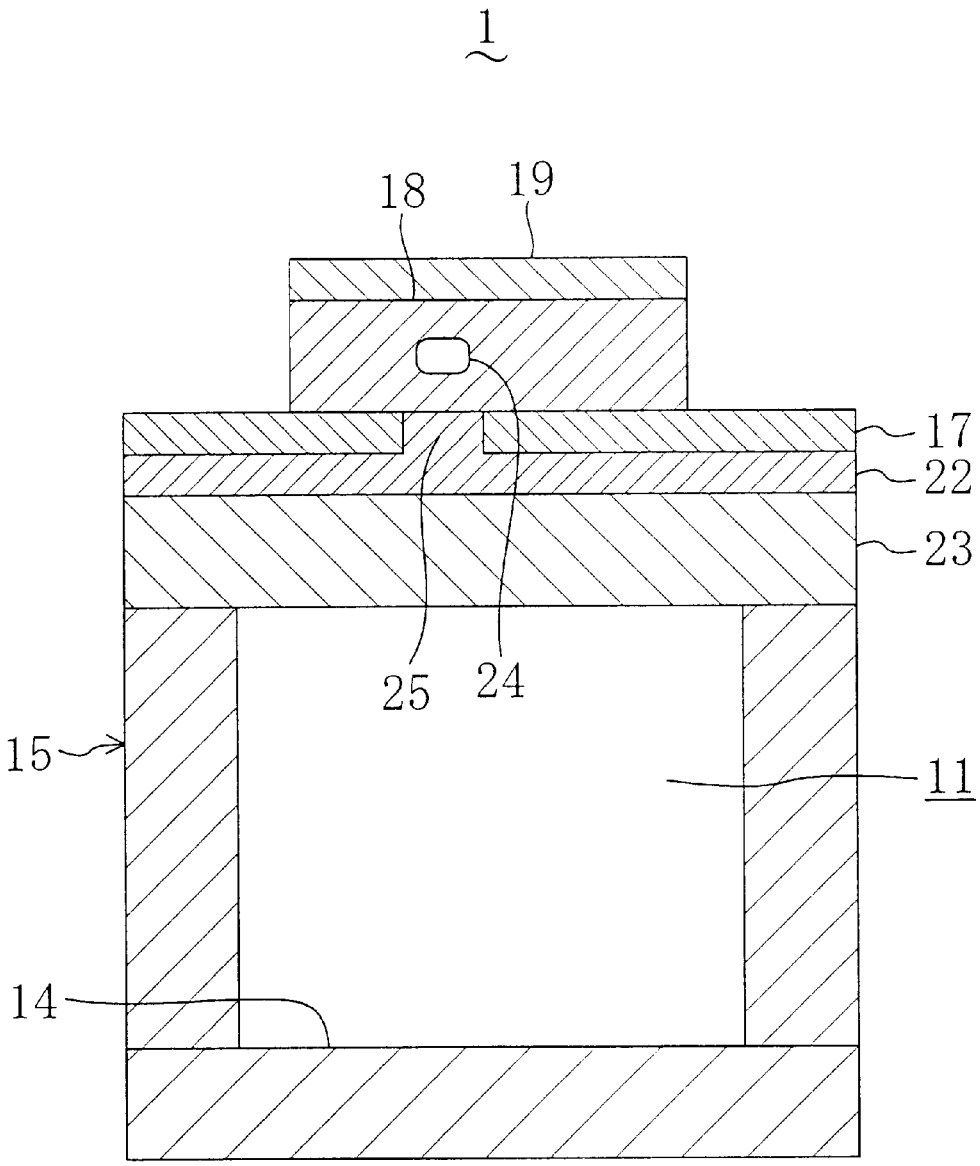
FIG. 3 is a cross-sectional view illustrating a part of an ink jet head.
Figure 4A:
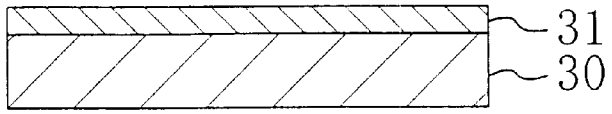
FIG. 4 shows production process diagrams each illustrating a part of the process of producing an ink jet head.
Figure 4B:
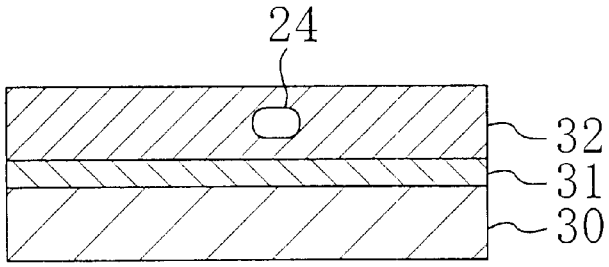
Figure 4C:
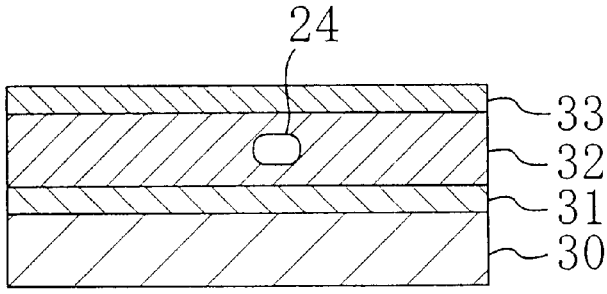
Figure 4D:
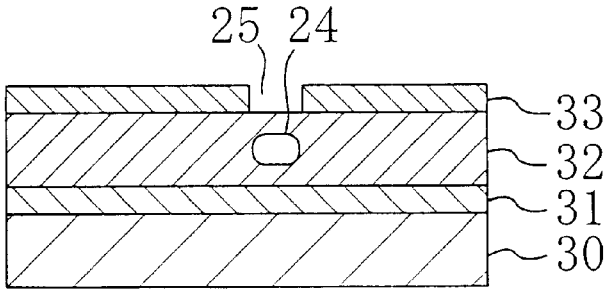

As illustrated in FIG. 3, in the common electrode 17, a discontinuity portion 25 is formed at a position below a defective portion 24 of the piezoelectric element 18. The discontinuity portion 25 is filled with a portion of the insulative layer 22. In other words, the portion of the common electrode 17 corresponding to the defective portion 24 is a portion where the electrode is locally absent. Thus, the defective portion 24 of the piezoelectric element 18 is a no-voltage-application portion where the applied voltage is locally absent even when a voltage is applied between the separate electrode 19 and the common electrode 17. Note that while the defective portion 24 is shown exaggerated in the figure, the volume proportion of the defective portion 24 with respect to the piezoelectric element 18 is very small, i.e., about 0.4%. Accordingly, the area of the discontinuity portion 25 of the common electrode 17 is also very small, whereby the ink discharging performance does not deteriorate due to the presence of the discontinuity portion 25.

Method for Producing Ink Jet Head

Next, a method for producing the ink jet head 1 will be described with reference to FIG. 4 to FIG. 6.

First, as illustrated in FIG. 4(*a*), a lower electrode 31 made of platinum and having a thickness of 0.1 μm to 0.2 μm is formed by sputtering, vapor deposition, or the like, on the surface of a first substrate (first base material) 30 made of magnesium oxide (MgO). Then, as illustrated in FIG. 4(*b*), a piezoelectric element 32 made of PZT (lead zirconate titanate) and having a thickness of 3 μm is formed by sputtering, vapor deposition, or the like, on the surface of the lower electrode 31. Note that during this process, the defective portion 24 may occur in the piezoelectric element 32. Thereafter, as illustrated in FIG. 4(*c*), an upper electrode 33 made of platinum and having a thickness of 0.1 μm is formed by sputtering, vapor deposition, or the like, on the surface of the piezoelectric element 32 (upper electrode deposition step). The upper electrode 33 is to be used, as it is, as the common electrode 17 (see FIG. 6(*c*)).

Figure 7A:
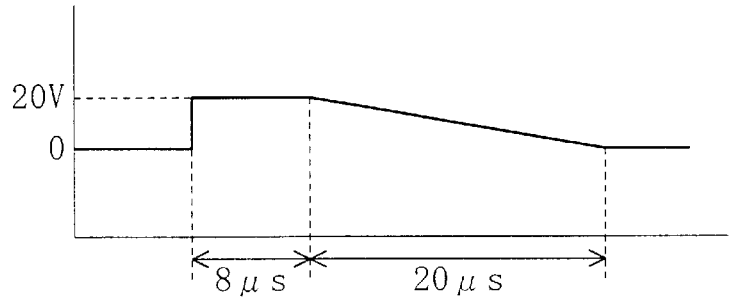
FIG. 7(*a*) is a waveform diagram illustrating a normal pulse voltage, and FIG. 7(*b*) is a waveform diagram illustrating a minute pulse voltage.
Figure 7B:
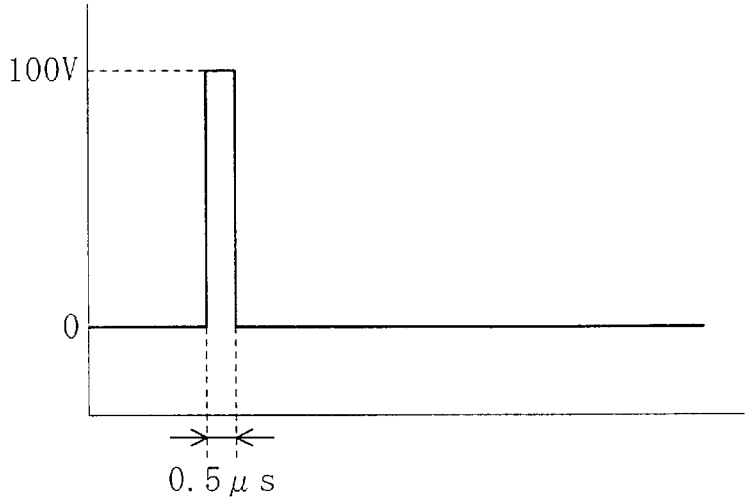

Then, as illustrated in FIG. 4(*d*), a predetermined minute pulse voltage having a larger voltage value and a shorter application duration than a normal pulse voltage, which is applied for discharging ink, is applied between the upper electrode 33 and the lower electrode 31 so as to cause minute dielectric breakdown (minute dielectric breakdown step). Specifically, in the present embodiment, a normal pulse voltage, which is applied for deforming the vibration plate 23 so as to apply a pressure on the ink in the pressure chamber 11, has a maximum voltage value of 20 V and an application duration of 28 μs, as illustrated in FIG. 7(*a*). In contrast, a minute pulse voltage applied during the minute dielectric breakdown step is a rectangular pulse voltage having a voltage value of 100 V and an application duration of 0.5 μs, as illustrated in FIG. 7(*b*). Thus, a large current abruptly flows locally through the defective portion 24 of the piezoelectric element 32, thereby causing minute dielectric breakdown. The heat caused by the minute dielectric breakdown melts and vaporizes a portion of the upper electrode 33 above the defective portion 24, thereby removing the corresponding portion of the upper electrode 33. As a result, the discontinuity portion 25 is formed in the upper electrode 33.

Figure 5A:
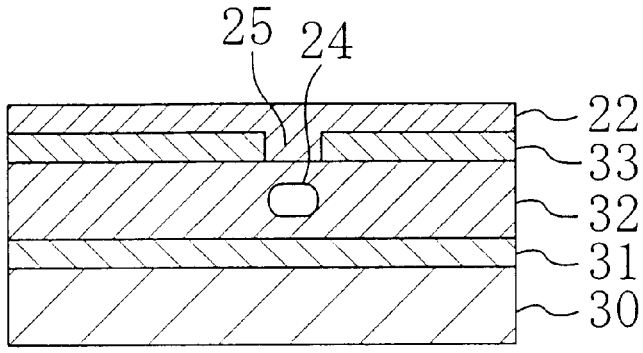
FIG. 5 shows production process diagrams each illustrating a part of the process of producing an ink jet head.
Figure 5B:
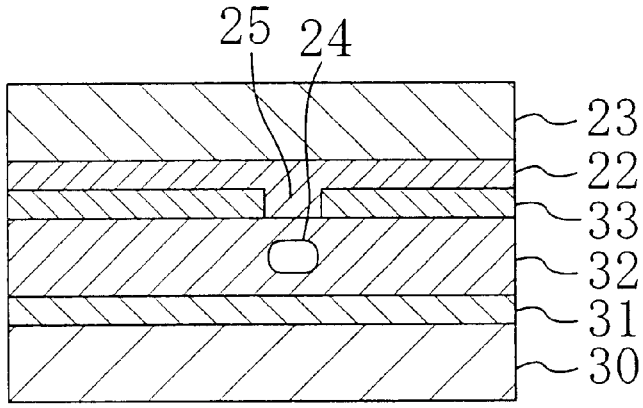
Figure 5C:
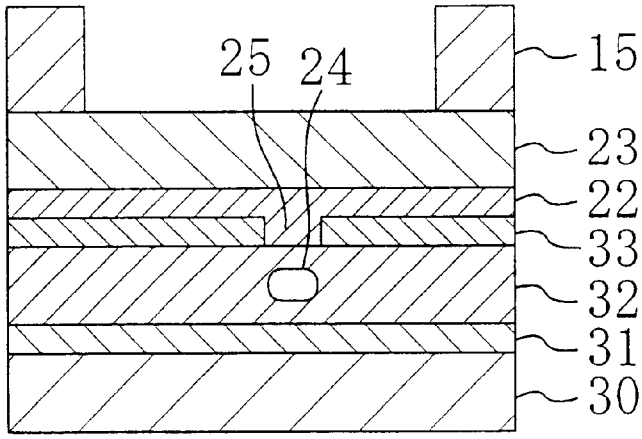

Then, as illustrated in FIG. 5(*a*), the insulative layer 22 having a thickness of 0.5 μm is formed on the surface of the upper electrode 33 by a spin-coating method, or the like, so as to cover at least the discontinuity portion 25 (insulative layer formation step). Note that in the present embodiment, a portion of the insulative layer 22 is used to fill up the discontinuity portion 25. In other words, an insulator is embedded in the discontinuity portion 25. Then, as illustrated in FIG. 5(*b*), the vibration plate 23 made of chromium and having a thickness of 4 μm is formed on the surface of the insulative layer 22 by sputtering, vapor deposition, or the like (vibration plate deposition step). Thereafter, as illustrated in FIG. 5(*c*), the head body 15 (second base material) which has been previously provided with the pressure chamber depressions 14, the nozzles 12, etc., is attached to the vibration plate 23 through adhesion, or the like.

Figure 6A:
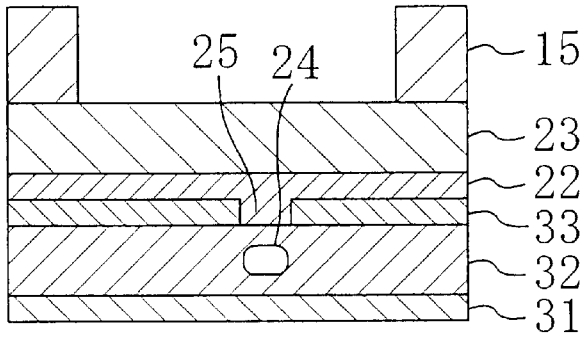
FIG. 6 shows production process diagrams each illustrating a part of the process of producing an ink jet head.
Figure 6B:
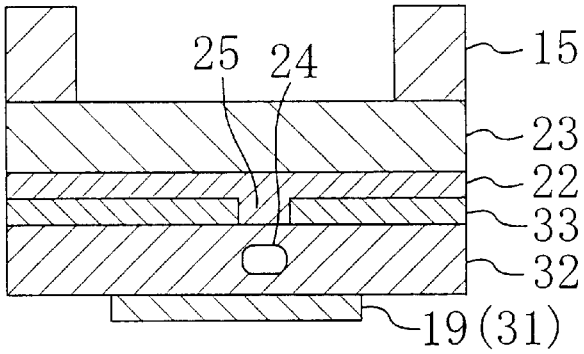
Figure 6C:
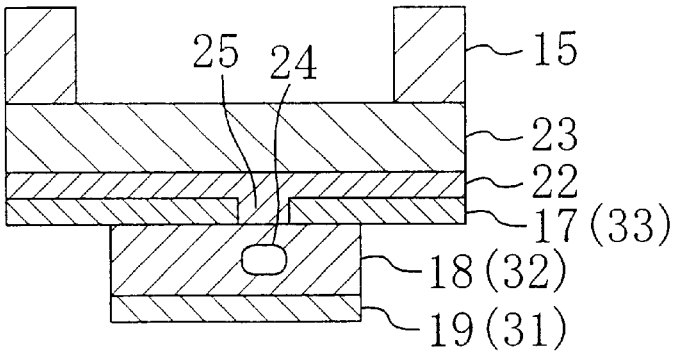

Then, as illustrated in FIG. 6(*a*), the first substrate 30 is removed. Then, as illustrated in FIG. 6(*b*), the lower electrode 31 is partially removed by etching so as to leave only predetermined portions of the lower electrode 31 including portions corresponding to the pressure chambers 11. Through such a patterning operation, the plurality of separate electrodes 19 respectively corresponding to the pressure chambers 11 are formed from the lower electrode 31. Then, as illustrated in FIG. 6(*c*), the piezoelectric element 32 is partially removed by etching so as to leave only predetermined portions of the piezoelectric element 32 including portions corresponding to the pressure chambers 11, thereby forming the plurality of piezoelectric elements 18 respectively corresponding to the pressure chambers 11, in a manner similar to that for the separate electrodes 19.

Effects of the Present Embodiment

As described above, according to the present embodiment, even if the defective portion 24 is included:in the piezoelectric element 18, a portion of the upper electrode 33 (=common electrode 17) corresponding to the defective portion 24 is the discontinuity portion 25 from which the material has been removed by minute dielectric breakdown, whereby even when a normal voltage is applied between the separate electrode 19 and the common electrode 17, the applied voltage is locally absent in the defective portion 24. Therefore, even if the defective portion 24 is included in the piezoelectric element 18, no dielectric breakdown occurs in the defective portion 24, whereby the performance and quality of the ink jet head 1 do not deteriorate. Therefore, it is possible to obtain the ink jet head 1 having the thin film piezoelectric element 18 with a desirable voltage endurance.

Particularly, in the present embodiment, an insulator is embedded in the discontinuity portion 25 of the common electrode 17, whereby the application of a normal voltage through the defective portion 24 is reliably prevented by the insulator. Therefore, the voltage endurance of the piezoelectric element 18 is further improved.

In a case where the discontinuity portion 25 is present in the upper electrode 33, if the vibration plate 23 is formed directly on the surface of the upper electrode 33, a difference in level may occur in a portion corresponding to the discontinuity portion 25. However, in the present embodiment, the insulative layer 22 is provided on the surface of the upper electrode 33, and the vibration plate 23 is provided above the upper electrode 33 via the insulative layer 22, whereby even if the discontinuity portion 25 is present in the upper electrode 33, the plane on which to form the vibration plate 23 (i.e., the upper surface of the insulative layer 22) is parallel to the piezoelectric element 32. Therefore, since the vibration plate 23 can be formed parallel to the piezoelectric element 18, the operation of the vibration plate 23 can be stabilized and the ink discharging performance is not deteriorated even if the area of the discontinuity portion 25 is large.

Moreover, by making the upper electrode 33 to be thinner than the lower electrode 31, it is possible to easily remove only a portion of the upper electrode 33 without damaging the lower electrode 31 in the minute dielectric breakdown step. Therefore, since the discontinuity portion 25 is formed only on the side of the upper electrode 33, the embedding of an insulator in the discontinuity portion 25 is facilitated.

Note that the minute pulse voltage to be applied in the minute dielectric breakdown step only needs to have a high voltage value and a short application duration, and is not limited to a rectangular pulse voltage. Moreover, the minute pulse voltage is not limited to a single pulse voltage but may alternatively be composed of a plurality of small pulses.

Moreover, in the present embodiment, the patterning of the lower electrode 31 is performed in the final phase of the production process (FIG. 6(*b*)). Alternatively, after the lower electrode 31 is formed on the first substrate 30, the lower electrode 31 may be patterned, after which the piezoelectric element 32 is deposited thereon.

Embodiment 2

Figure 8:
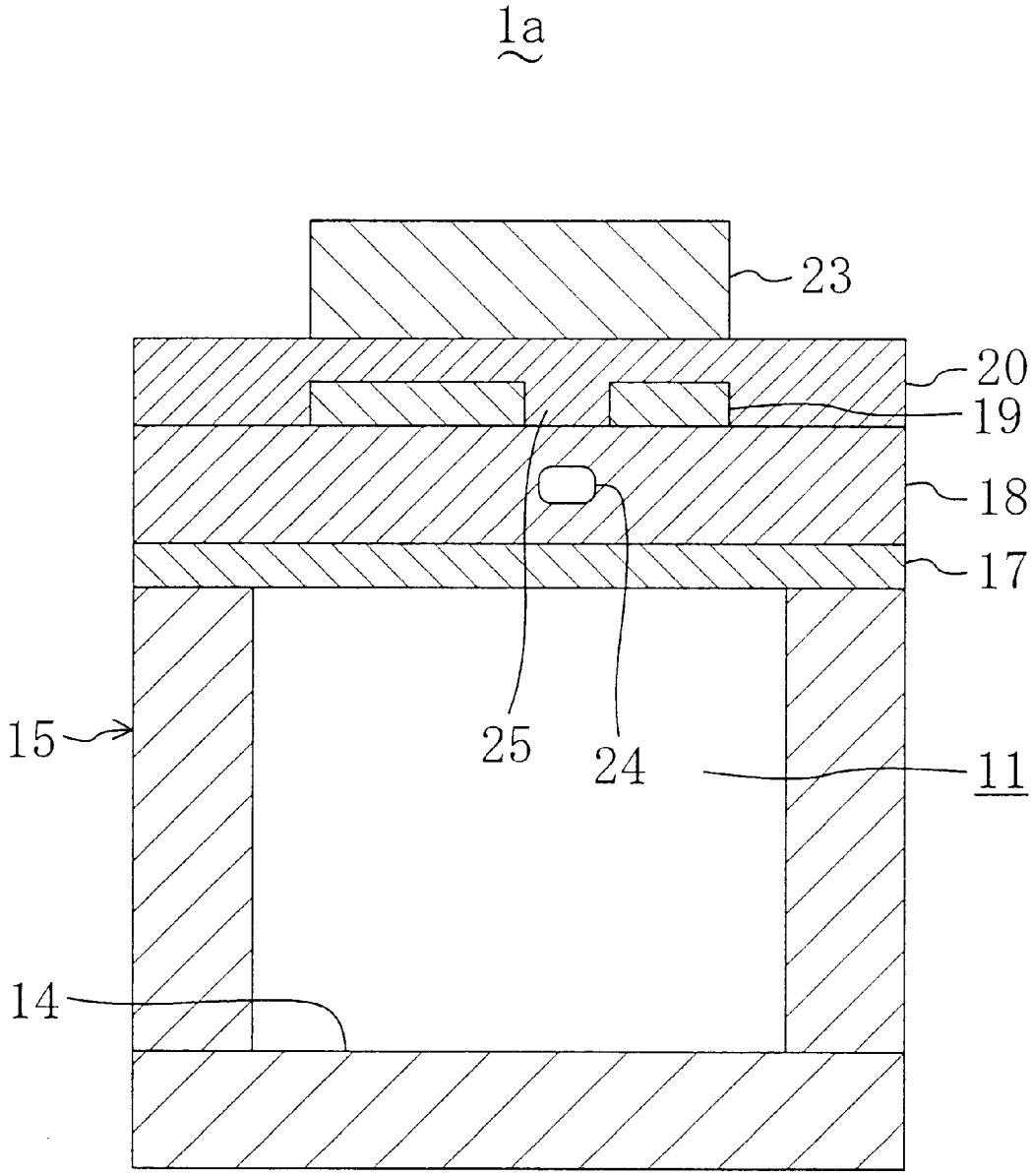
FIG. 8 is a cross-sectional view illustrating a part of an ink jet head.

As illustrated in FIG. 8, in an ink jet head 1*a* according to Embodiment 2, the vibration plate 23 is formed as separate portions respectively corresponding to the pressure chambers 11. The common electrode 17 made of platinum and having a thickness of 0.1 μm to 0.2 μm is provided on the surface of the head body 15 so as to cover each pressure chamber depression 14. The piezoelectric element 18 made of a thin PZT film having a thickness of 3 μm is provided on the surface of the common electrode 17, and the separate electrode 19 made of platinum and having a thickness of 0.1 μm is provided on the surface of the piezoelectric element 18 so as to correspond to each pressure chamber 11. An insulative layer 20 is formed beside and above the separate electrode 19 so as to fill up the gap between adjacent separate electrodes 19 in order to prevent short-circuiting between the separate electrodes 19. The vibration plate 23 made of chromium and having a thickness of 4 μm is formed on the surface of the insulative layer 20 so as to correspond to each pressure chamber 11.

The discontinuity portion 25 is provided in the separate electrode 19 at a position above the defective portion 24 of the piezoelectric element 18. As in Embodiment 1, the defective portion 24 is filled up with a portion of the insulative layer 20, and thus the defective portion 24 becomes a no-voltage-application portion where the applied voltage is locally absent.

Next, a method for producing the ink jet head 1*a* will be described with reference to FIG. 9 to FIG. 11.

Figure 9A:
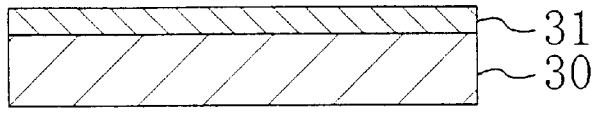
FIG. 9 shows production process diagrams each illustrating a part of the process of producing an ink jet head.
Figure 9B:
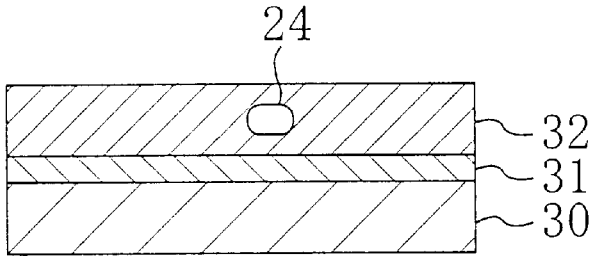
Figure 9C:
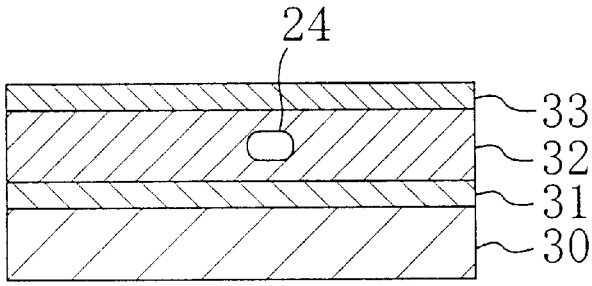

First, as illustrated in FIG. 9(*a*), the lower electrode 31 made of platinum and having a thickness of 0.1 μm to 0.2 μm is formed by sputtering, vapor deposition, or the like, on the surface of the first substrate 30 made of magnesium oxide. Note that the lower electrode 31 is to be used, as it is, as the common electrode 17 (see FIG. 11(*c*)). Then, as illustrated in FIG. 9(*b*), the piezoelectric element 32 made of PZT and having a thickness of 3 μm is formed by sputtering, vapor deposition, or the like, on the surface of the lower electrode 31. Note that during this process, a defect may occur in the piezoelectric element 32. Then, as illustrated in FIG. 9(*c*), the upper electrode 33 made of platinum and having a thickness of 0.1 μm is formed by sputtering, vapor deposition, or the like, on the surface of the piezoelectric element 32 (upper electrode deposition step).

Then, as in Embodiment 1, a minute pulse voltage is applied between the upper electrode 33 and the lower electrode 31. Thus, as illustrated in FIG. 10(*a*), a large current abruptly flows locally through the defective portion 24 of the piezoelectric element 32, thereby causing minute dielectric breakdown. The minute dielectric breakdown vaporizes a portion of the upper electrode 33 above the defective portion 24, thereby removing the corresponding portion of the upper electrode 33. As a result, the discontinuity portion 25 is formed in the upper electrode 33 (minute dielectric breakdown step).

Figure 10A:
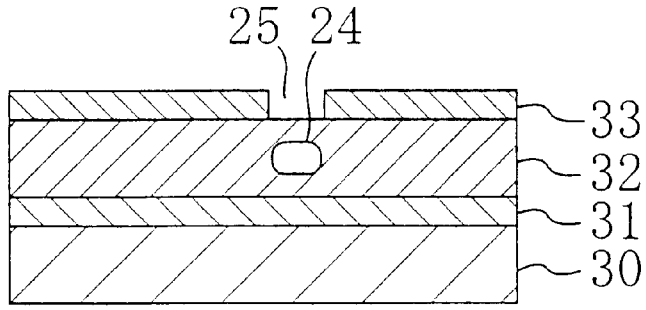
FIG. 10 shows production process diagrams each illustrating a part of the process of producing an ink jet head.
Figure 10B:
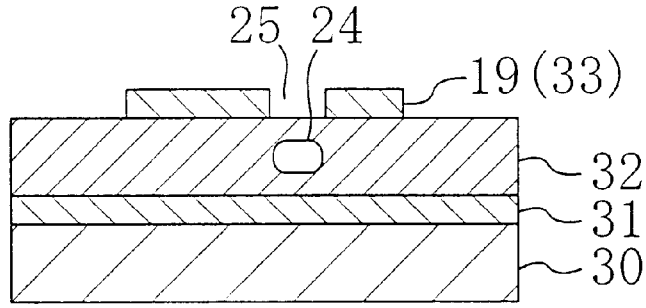
Figure 10C:
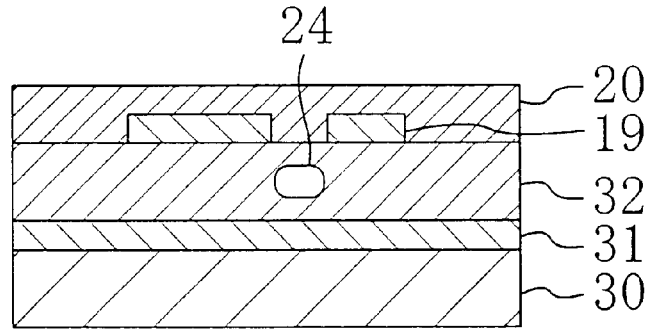

Then, as illustrated in FIG. 10(*b*), the upper electrode 33 is partially removed by etching, or the like, so as to leave only predetermined portions of the upper electrode 33. Through such a patterning operation, the plurality of separate electrodes 19 are formed from the upper electrode 33. Thereafter, as illustrated in FIG. 10(*c*), the insulative layer 20 for filling up the gap between adjacent separate electrodes 19 and the discontinuity portion 25 is formed by a spin-coating method, or the like. In other words, an insulator is embedded in the gap between the separate electrodes 19 and in the discontinuity portion 25. Note that the thickness of the insulative layer 20 only needs to be equal to or greater than the thickness of the separate electrode 19 and, in the present embodiment, the thickness of the insulative layer 20 is set to be greater than the thickness of the separate electrode 19.

Figure 11A:
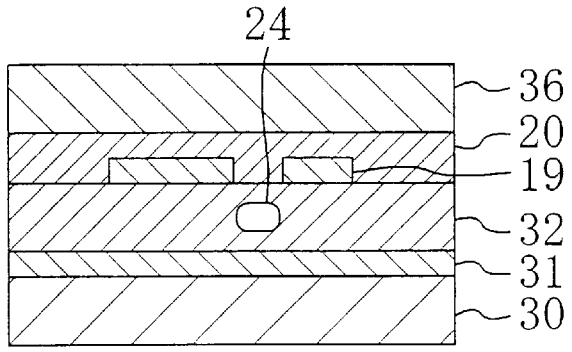
FIG. 11 shows production process diagrams each illustrating a part of the process of producing an ink jet head.
Figure 11B:
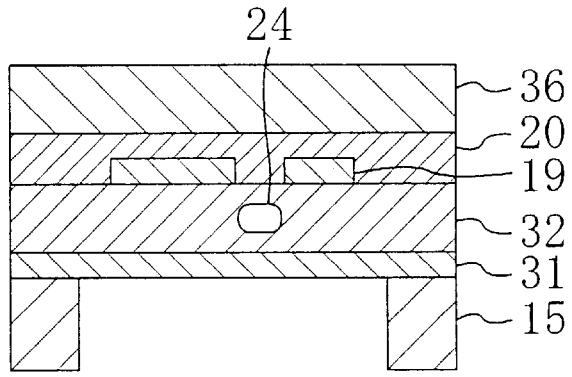
Figure 11C:
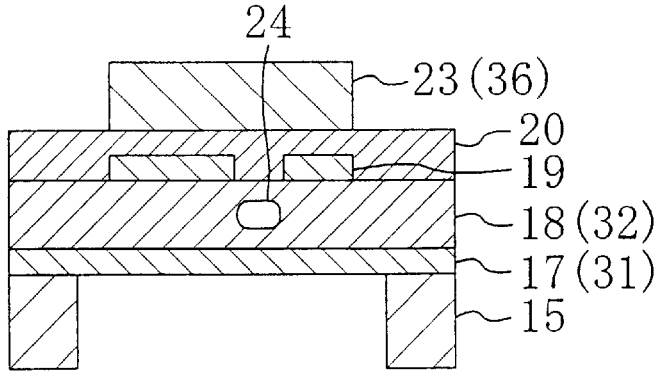

Then, as illustrated in FIG. 11(*a*), a vibration plate 36 made of chromium and having a thickness of 4 μm is formed by sputtering, vapor deposition, or the like, on the surface of the insulative layer 20. Thereafter, as illustrated in FIG. 11(*b*), the first substrate 30 is processed so that the pressure chambers 11 are formed at positions respectively corresponding to the separate electrodes 19. Then, as illustrated in FIG. 11(*c*), the vibration plate 36 is etched and patterned so as to leave only predetermined portions of the vibration plate 36 including portions corresponding to the separate electrodes 19. Thus, the plurality of vibration plates 23 respectively corresponding to the pressure chambers 11 are formed from the vibration plate 36.

As described above, also in Embodiment 2, a portion of the separate electrode 19 corresponding to the defective portion 24 is provided as the discontinuity portion 25, whereby no dielectric breakdown occurs in the defective portion 24 even when a normal voltage is applied between the separate electrode 19 and the common electrode 17. Moreover, since an insulator is embedded in the discontinuity portion 25, effects as those of Embodiment 1, e.g., the effect of reliably preventing the application of the normal voltage through the defective portion 24, can be obtained.

Embodiment 3

Figure 12:
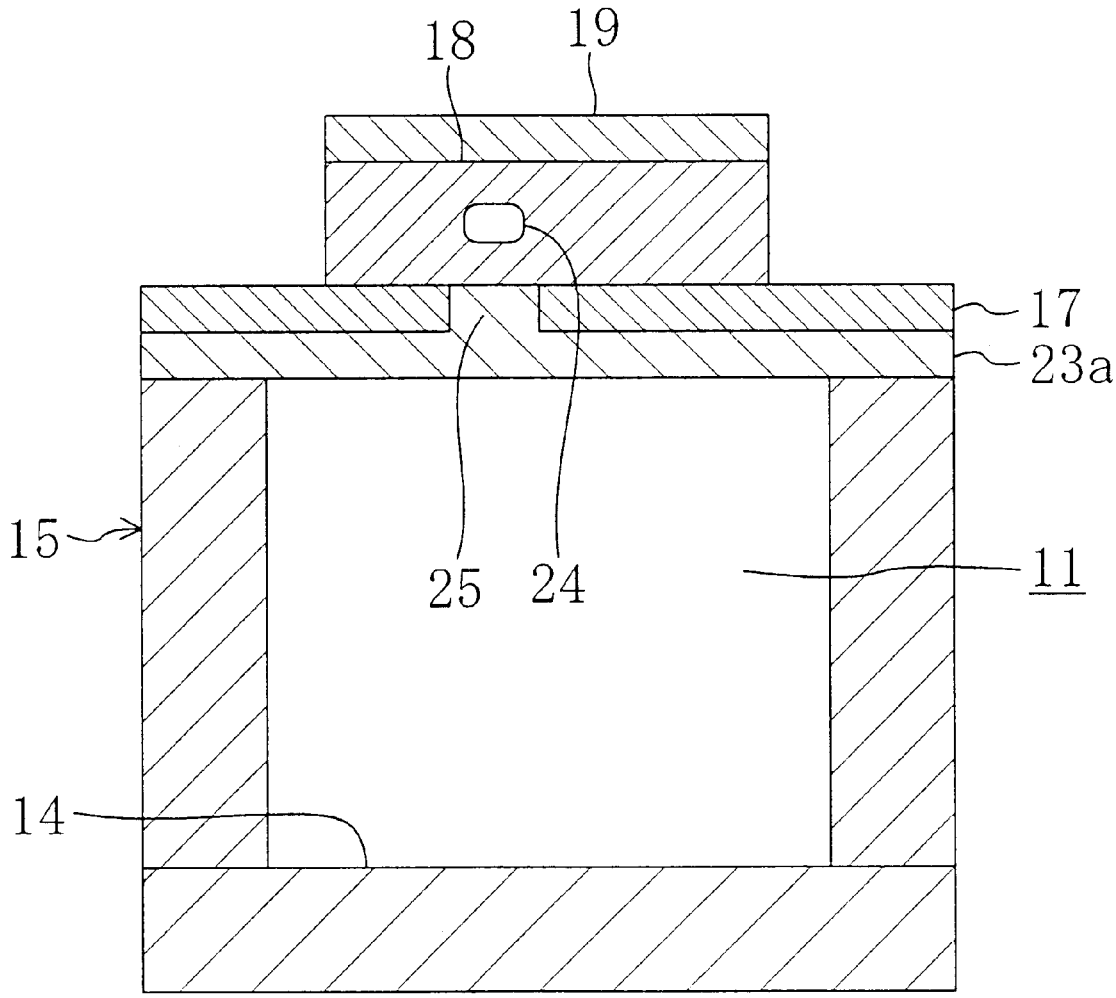
FIG. 12 is a cross-sectional view illustrating a part of an ink jet head.

A vibration plate 23*a* which functions also as the insulative layer 22 may be provided as illustrated in FIG. 12 instead of separately providing the insulative layer 22 and the vibration plate 23 as in Embodiment 1 (see FIG. 3).

Such an ink jet head may be obtained according to Embodiment 1 except for forming the insulative vibration plate 23*a* on the upper electrode 33 instead of forming the insulative layer 22 on the upper electrode 33 (insulative layer formation step) and forming the vibration plate 23 on the insulative layer 22 (vibration plate deposition step).

Figure 13:
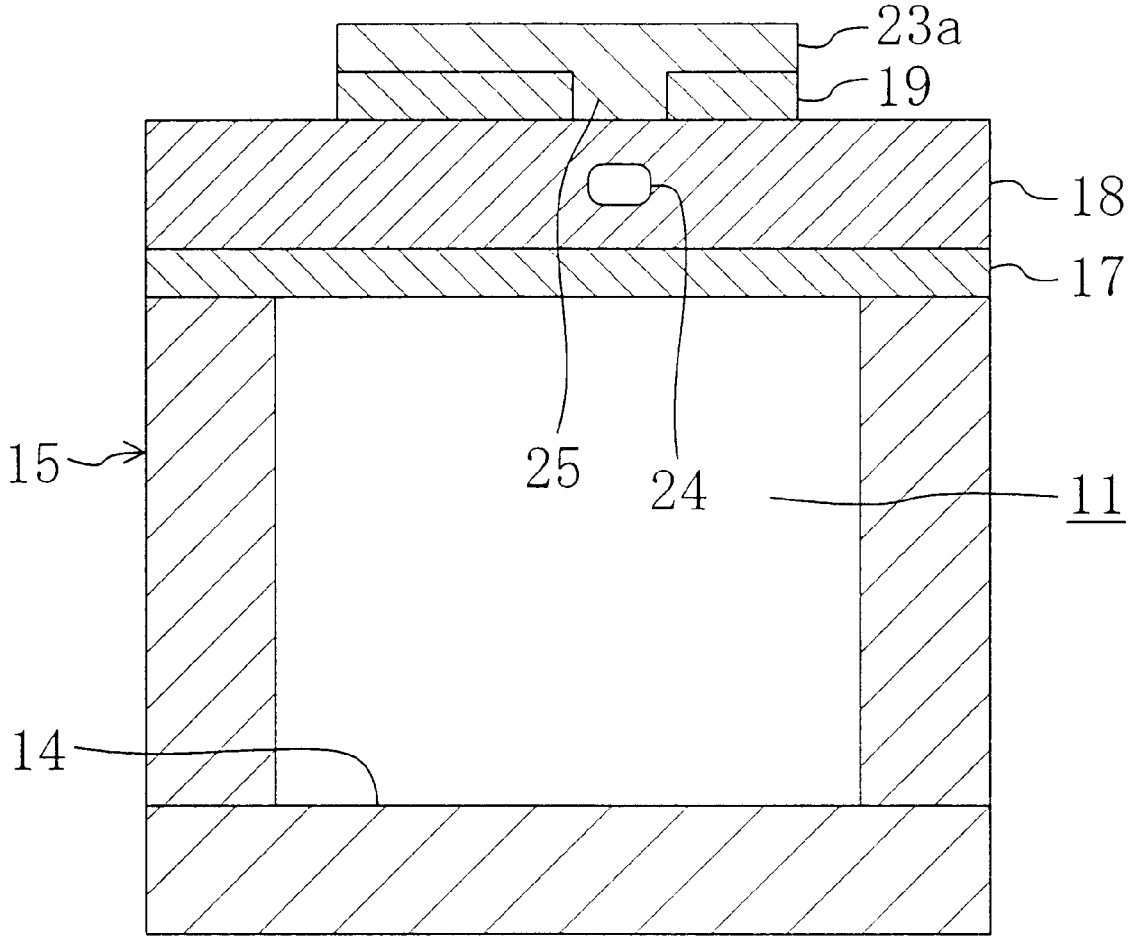
FIG. 13 is a cross-sectional view illustrating a part of an ink jet head.
Figure 14A:
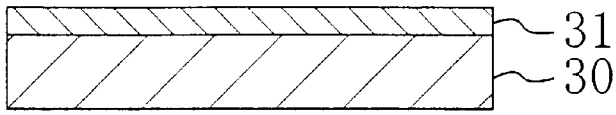
FIG. 14 shows production process diagrams each illustrating a part of the process of producing an ink jet head.
Figure 14B:
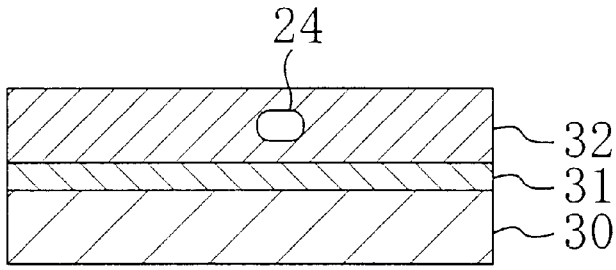
Figure 14C:
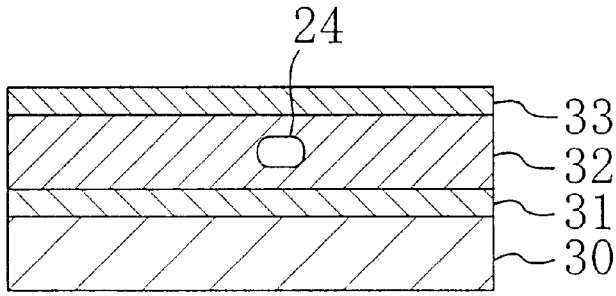
Figure 14D:
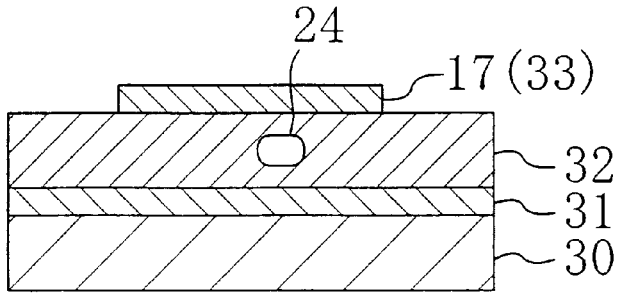
Figure 15A:
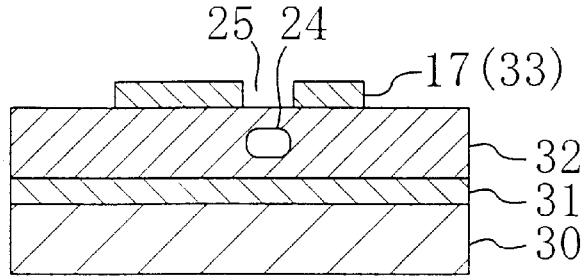
FIG. 15 shows production process diagrams each illustrating a part of the process of producing an ink jet head.
Figure 15B:
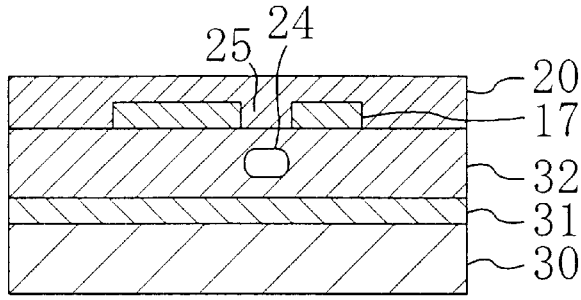
Figure 15C:
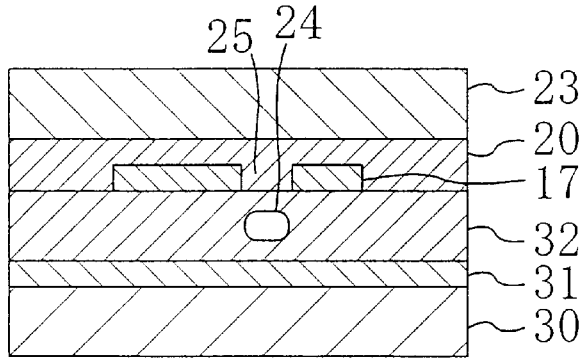
Figure 15D:
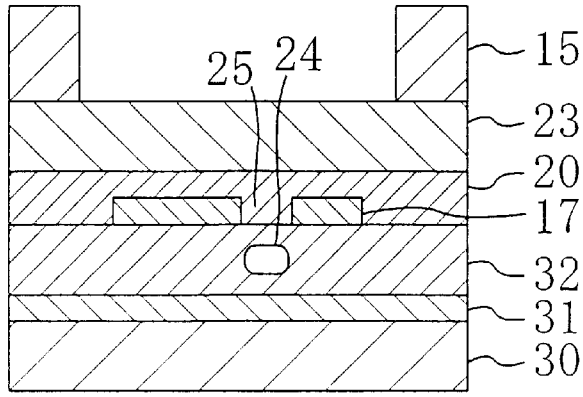

Alternatively, it may be obtained according to Embodiment 2 except for forming the insulative vibration plate 23*a* on the separate electrode 19 as illustrated in FIG. 13 instead of sequentially forming the insulative layer 20 and the vibration plate 36 on the separate electrode 19.

Embodiment 4

While the insulative vibration plate 23*a* is used in Embodiment 3, a conductive vibration plate may alternatively be used so that the vibration plate functions also as the common electrode, instead of separately providing a vibration plate and a common plate. In other words, the vibration plate itself may be used as: an electrode.

For example, such an ink jet head may be produced as follows. First, the lower electrode 31 is formed on the first substrate 30, the piezoelectric element 32 is formed on the lower electrode 31, and a conductive vibration plate is formed on the piezoelectric element 32. Thereafter, a minute pulse voltage is applied between the conductive vibration plate and the lower electrode 31 so as to cause minute dielectric breakdown, thereby forming the discontinuity portion 25 in the conductive vibration plate. Then, the insulative layer 22 is formed on the conductive vibration plate so as to fill up the discontinuity portion 25, and the head body 15 is attached to the insulative layer 22. Thereafter, the first substrate 30 is removed, and the lower electrode 31 and the piezoelectric element 32 are patterned. Note that since the conductive vibration plate has a relatively large thickness, the discontinuity portion may be formed in the separate electrode 19 instead of in the conductive vibration plate in order to facilitate the formation of the discontinuity portion. For example, after reaching the state as illustrated in FIG. 6(*c*), the discontinuity portion may be provided in the separate electrode 19 through dielectric breakdown.

Thus, as the vibration plate functions also as the common electrode, it is no longer necessary to separately form the vibration plate and the common electrode, whereby it is possible to downsize the head and reduce the production cost.

Alternatively, in Embodiment 2, the separate electrode 19 may be omitted, with the vibration plate functioning also as the separate electrode, as will be described below.

Specifically, first, the lower electrode 31 is formed on the first substrate 30, the piezoelectric element 32 is formed on the lower electrode 31, and a conductive vibration plate is formed on the piezoelectric element 32. Thereafter, a minute pulse voltage is applied between the conductive vibration plate and the lower electrode 31 so as to cause minute dielectric breakdown, thereby forming the discontinuity portion 25 in the conductive vibration plate. Then, the insulative layer 22 is formed on the conductive vibration plate so as to fill up the discontinuity portion 25. Thereafter, the first substrate 30 is processed so as to form the pressure chambers 11, etc. Then, the conductive vibration plate and the insulative layer 22 are patterned to form a plurality of conductive vibration plates respectively corresponding to the pressure chambers 11.

Thus, as the vibration plate functions also as the separate electrode, it is no longer necessary to separately form the vibration plate and the separate electrode, whereby it is possible to downsize the head and reduce the production cost.

Embodiment 5

Figure 16A:
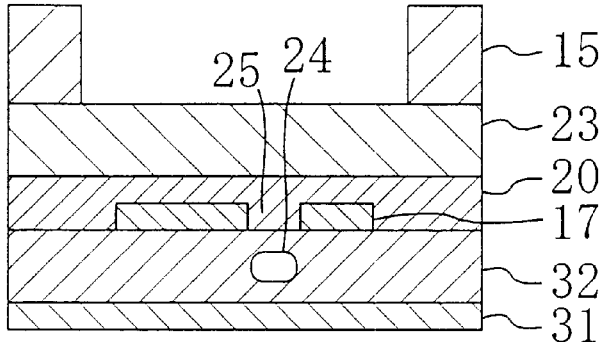
FIG. 16 shows production process diagrams each illustrating a part of the process of producing an ink jet head.
Figure 16B:
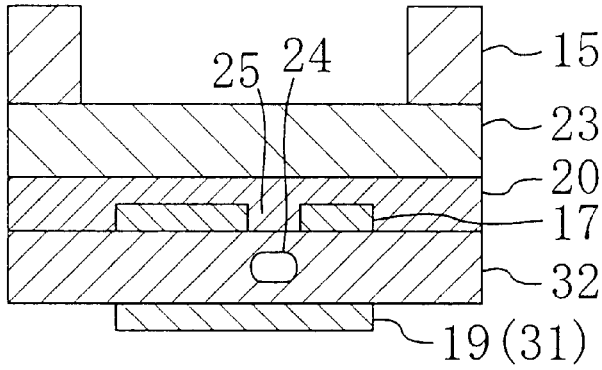
Figure 16C:
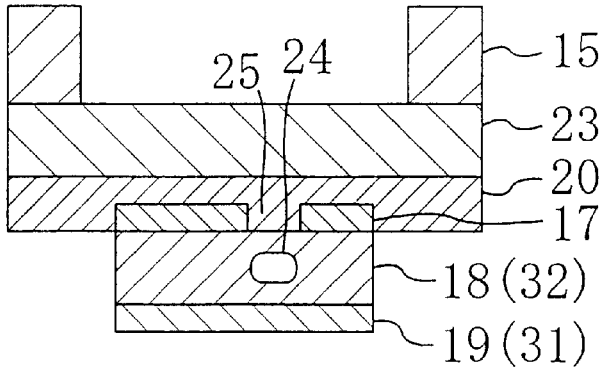

Embodiment 5 is similar to Embodiment 1 except that the application of a minute voltage in the minute dielectric breakdown step is performed after patterning the upper electrode as illustrated in FIG. 14 to FIG. 16.

In the present embodiment, first, as illustrated in FIG. 14(*a*) to FIG. 14(*c*), the lower electrode 31, the piezoelectric element 32 and the upper electrode 33 are sequentially deposited on the first substrate 30 made of magnesium oxide. Thereafter, as illustrated in FIG. 14(*d*), the upper electrode 33 is, patterned (separated). Then, as illustrated in FIG. 15(*a*), a predetermined voltage is applied between the upper electrode 33 and the lower electrode 31 so as to cause minute dielectric breakdown. As a result, the discontinuity portion 25 is formed in a portion of the upper electrode 33. Thereafter, the ink jet head is produced as in Embodiment 1, as sequentially illustrated in FIG. 15(*b*) to FIG. 15(*d*) and FIG. 16(*a*) to FIG. 16(*c*).

According to the present embodiment, in the minute dielectric breakdown step, the predetermined voltage is applied after patterning the upper electrode 33, whereby as compared to the case where the voltage is applied before the patterning operation, the amount of charge stored between the electrodes 33 and 31 can be reduced. Therefore, the degree of dielectric breakdown will not be excessive, whereby the minute dielectric breakdown can be easily controlled.

Figure 17A:
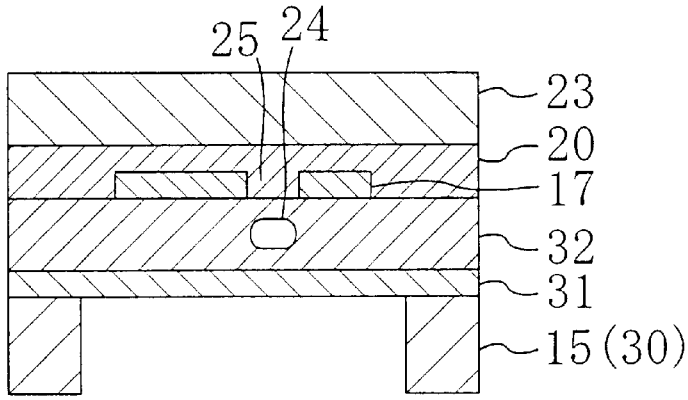
FIG. 17 shows production process diagrams each illustrating a part of the process of producing an ink jet head.
Figure 17B:
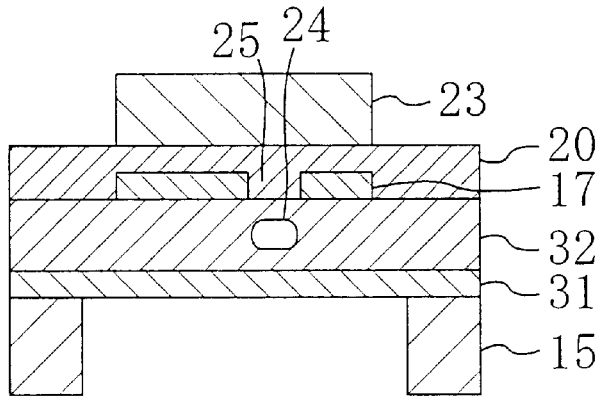
Figure 18A:
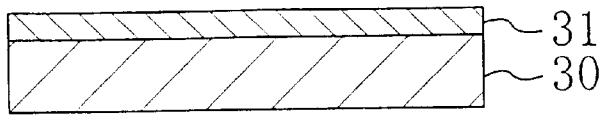
FIG. 18 shows production process diagrams each illustrating a part of the process of producing an ink jet head.
Figure 18B:
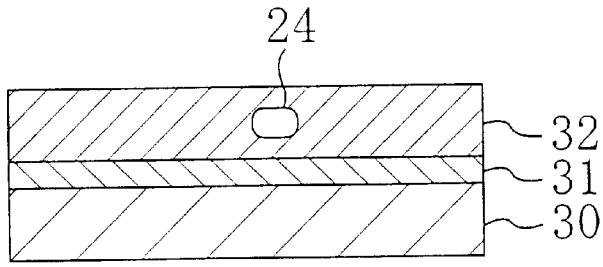
Figure 18C:
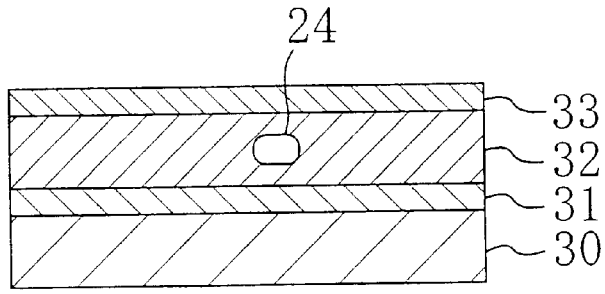
Figure 18D:
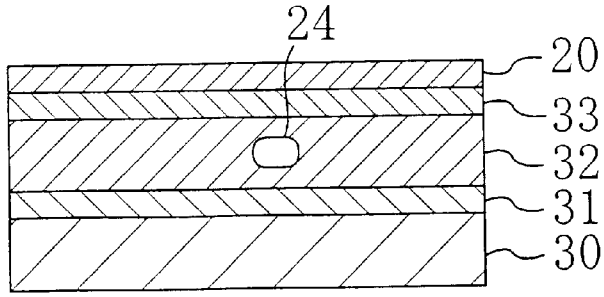

Alternatively, in Embodiment 2, the application of the minute voltage in the minute dielectric breakdown step may be performed after patterning the upper electrode. Specifically, after the steps shown in FIG. 14(*a*) to FIG. 14(*d*) and FIG. 15(*a*) to FIG. 15(*c*), the first substrate 30 may be processed to form the pressure chambers, etc., as illustrated in FIG. 17(*a*), and then the vibration plate 23 may be patterned as illustrated in FIG. 17(*b*).

Embodiment 6

Figure 19A:
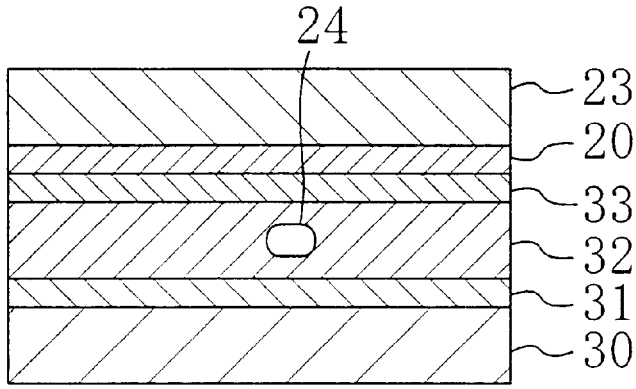
FIG. 19 shows production process diagrams each illustrating a part of the process of producing an ink jet head.
Figure 19B:
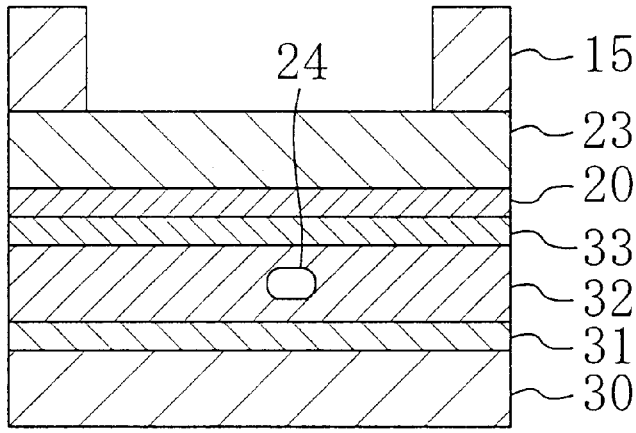
Figure 19C:
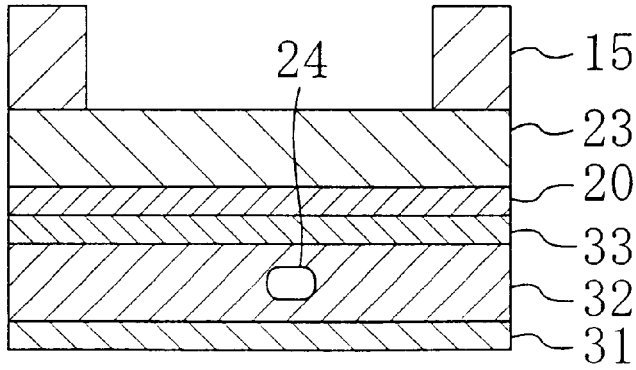
Figure 20A:
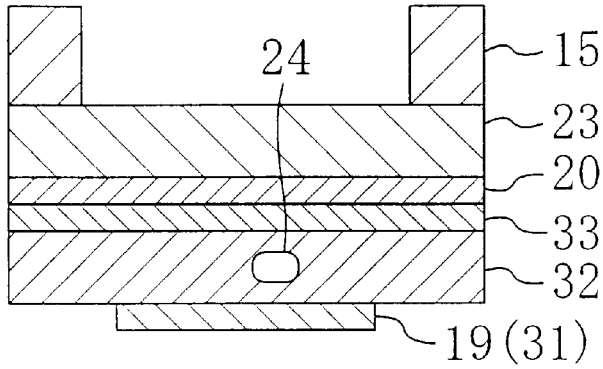
FIG. 20 shows production process diagrams each illustrating a part of the process of producing an ink jet head.
Figure 20B:
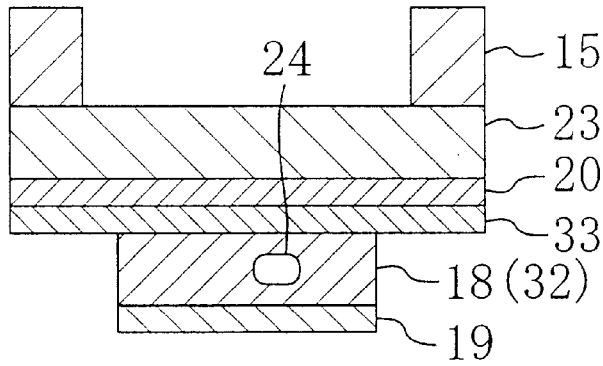
Figure 20C:
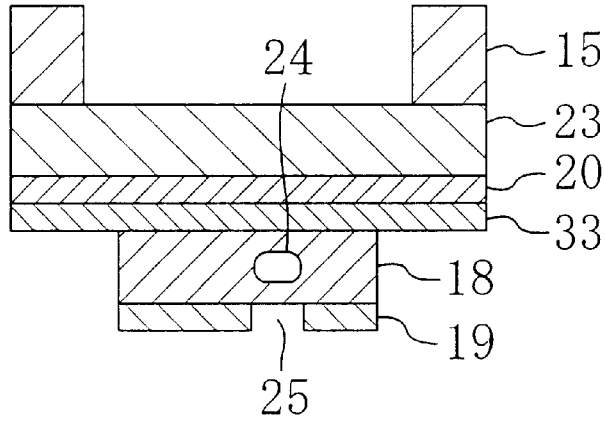

In Embodiment 6, the minute dielectric breakdown step is performed in the final phase of the production process as illustrated in FIG. 18 to FIG. 20.

Specifically, first, as sequentially illustrated in FIG. 18(*a*) to FIG. 18(*d*) and FIG. 19(*a*), the lower electrode 31, the piezoelectric element 32, the upper electrode 33, the insulative layer 20 and the vibration plate 23 are sequentially deposited on the first substrate 30. Thereafter, as illustrated in FIG. 19(*b*) and FIG. 19(*c*), the head body 15 is attached to the upper surface of the vibration plate 23, and then the first substrate 30 is removed. Then, as illustrated in FIG. 20(*a*) and FIG. 20(*b*), the lower electrode 31 is patterned into the separate electrodes 19, and then the piezoelectric element 32 is patterned. Then, as illustrated in FIG. 20(*c*), a predetermined voltage is applied between the upper electrode 33 and the separate electrode 19 so as to cause minute dielectric breakdown, thereby forming the discontinuity portion 25 in the separate electrode 19.

Note that in the present embodiment, the insulative layer 20 is not necessarily required, and the vibration plate 23 may function also as the upper electrode.

Embodiment 7

In Embodiment 7, a defective portion detection is performed during the production process of an ink jet head so as to remove the defective portion based on the detection results.

The basic method for producing the ink jet head is as that of Embodiment 1. First, as illustrated in FIG. 4(*a*), the lower electrode 31 made of platinum and having a thickness of 0.1 μm to 0.2 μm is formed by sputtering, vapor deposition, or the like, on the surface of the first substrate (first base material) 30 made of magnesium oxide (MgO). Then, as illustrated in FIG. 4(*b*), the piezoelectric element 32 made of PZT (lead zirconate titanate) and having a thickness of 3 μm is formed by sputtering, vapor deposition, or the like, on the surface of the lower electrode 31. Note that during this process, the defective portion 24 may occur in the piezoelectric element 32. Thereafter, as illustrated in FIG. 4(*c*), the upper electrode 33 made of platinum and having a thickness of 0.1 μm is formed by sputtering, vapor deposition, or the like, on the surface of the piezoelectric element 32 (upper electrode deposition step). Note that the upper electrode 33 is to be used, as it is, as the common electrode 17 (see FIG. 6(*c*)).

Then, the defective portion detection step is performed. In this step, first, minute pulse voltages each having a larger voltage value and a shorter application duration than a normal pulse voltage, which is applied for discharging ink, are successively applied between the upper electrode 33 and the lower electrode 31 at a predetermined cycle. In other words, a group of pulse voltages composed of a plurality of minute pulse voltages is applied between the electrodes 33 and 31.

Figure 21A:
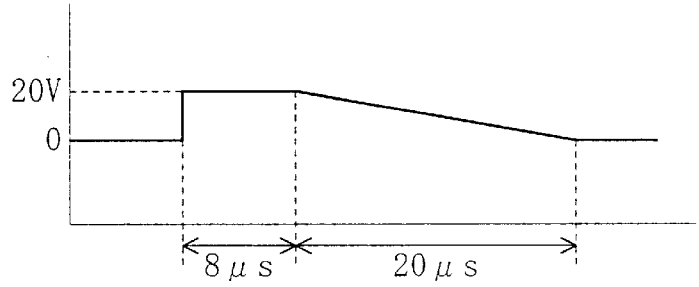
FIG. 21(*a*) is a waveform diagram illustrating a normal pulse voltage, and FIG. 21(*b*) is a waveform diagram illustrating a group of minute pulse voltages for temperature detection.
Figure 21B:
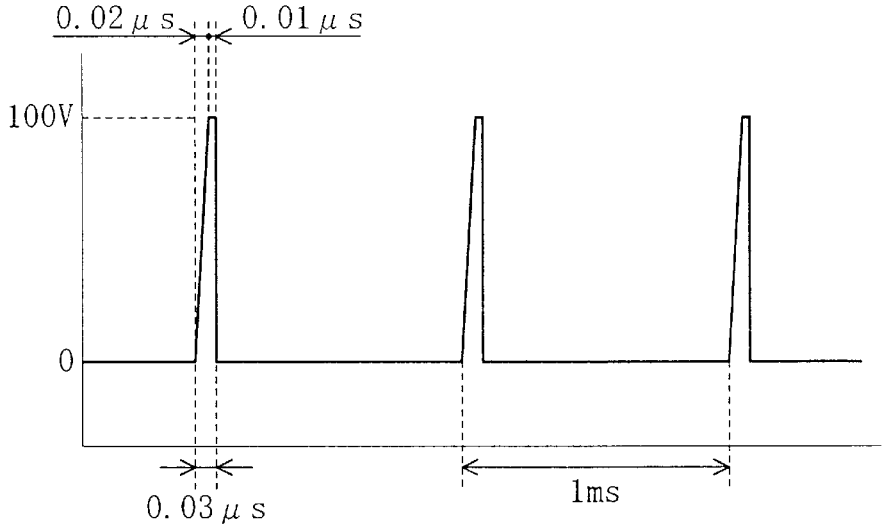

Specifically, in the present embodiment, a normal pulse voltage, which is applied for deforming the vibration plate 23 so as to apply a pressure on the ink in the pressure chamber 11, has a maximum voltage value of 20 V and an application duration of 28 μs, as illustrated in FIG. 21(*a*). In contrast, a minute pulse voltage applied during the defective portion detection step is a pulse voltage having a voltage value of 100 V and an application duration of 0.03 μs, as illustrated in FIG. 21(*b*). Note that when applying the minute pulse voltage, the current limiter is set to 1 A. Such a minute pulse voltage is applied for every 1 ms. In other words, the group of minute pulse voltages is composed of a plurality of minute pulse voltages which are successively applied at a cycle of 1 ms. Thus, if the defective portion 24 has occurred in the piezoelectric element 32, a current flows through the defective portion 24 due to dielectric breakdown so that a portion of the upper electrode 33 corresponding to the defective portion 24 is heated to a temperature higher than the temperature of the surrounding portions. Therefore, the upper electrode 33 takes a surface temperature distribution having the maximum point at a position corresponding to the defective portion 24. In view of this, the position at which the temperature of the upper electrode 33 takes the maximum value is then identified.

Figure 22:
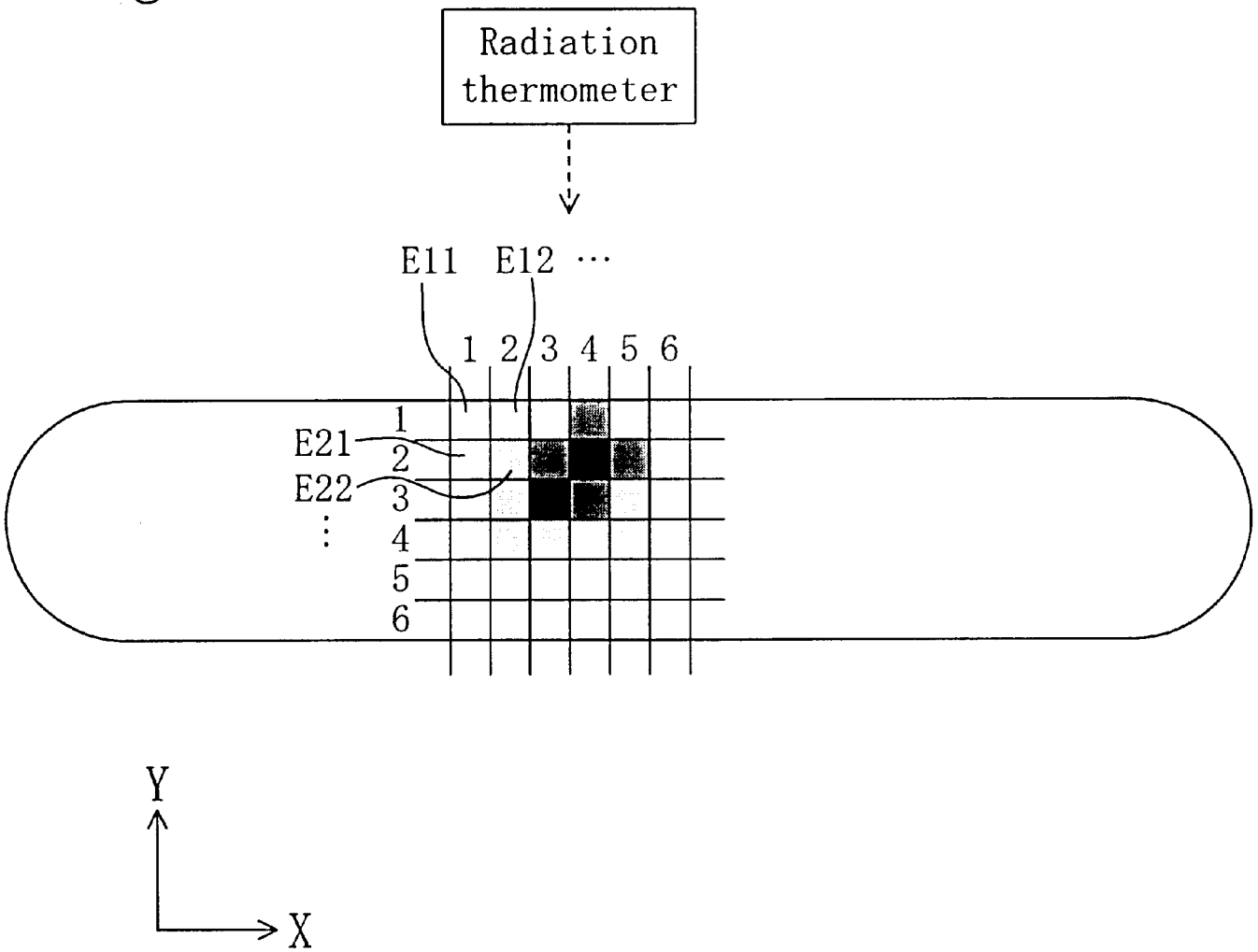
FIG. 22 is a diagram illustrating measurement elements of a radiation thermometer for measuring the surface temperature of an upper electrode layer.

First, the surface temperature of the upper electrode 33 is measured by using a radiation thermometer (thermography) from above the upper electrode 33 while applying the group of minute pulse voltages. Note that since a radiation thermometer has a predetermined resolution, the surface temperature of the upper electrode 33 is detected by elements each having a predetermined size (e.g., 20 μm×20 μm) as illustrated in FIG. 22. Moreover, since a radiation thermometer is configured so as to detect the temperature of the object at a predetermined sampling cycle, the temperature of the upper electrode 33 is detected at the sampling cycle. In this example, the sampling cycle is 1/60 s (one sixtieth second). Accordingly, the cycle at which the minute pulse voltages of the group of minute pulse voltages are applied is set to be less than or equal to the sampling cycle of the radiation thermometer.

Next, a specific example of a measurement of the surface temperature of the upper electrode 33 will be described. In the following description, the numbers of the elements detected by the radiation thermometer are designated by combined numbers, e.g., E11, E12, . . . , E21, E22, and so on, obtained by combining numbers 1, 2, 3, . . . , assigned in the horizontal direction (the X direction) in FIG. 22 and numbers 1, 2, 3, . . . , assigned along the vertical direction (the Y direction). First, the temperatures of the elements are compared with one another to identify the extreme value element whose temperature takes the maximum value. In this example, it is assumed that E33 is the extreme value element. Then, the temperatures T22, T23, T24, T32, T34, T42, T43 and T44 of the adjacent elements which are adjacent to the extreme value element E33, i.e., E22, E23, E24, E32, E34, E42, E43 and E44, are detected.

Figure 23:
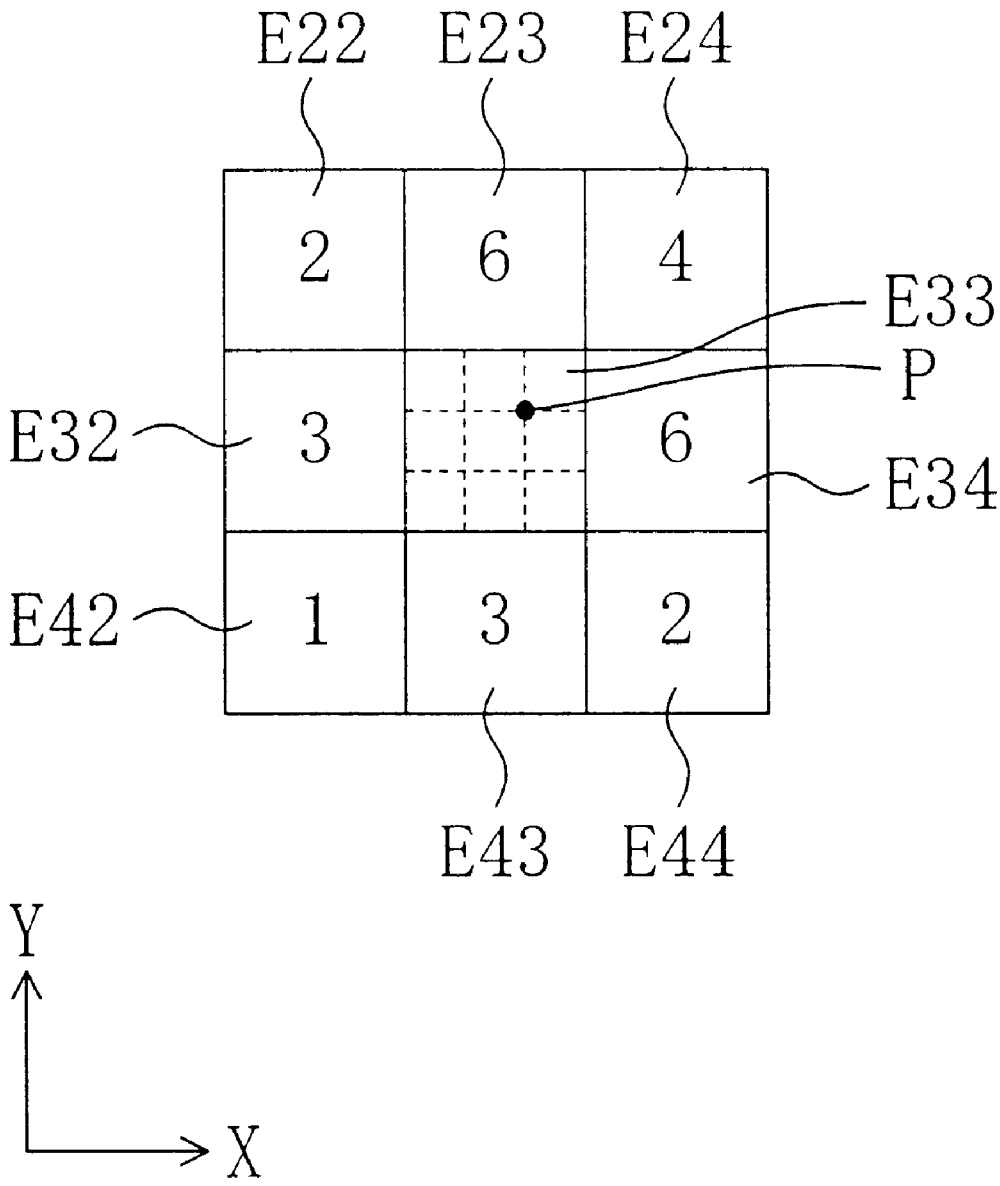
FIG. 23 is a diagram illustrating measurement elements of a radiation thermometer for measuring the surface temperature of an upper electrode layer.

Then, the temperature distribution within the extreme value element E33 is obtained by interpolation. Specifically, the distance from the extreme value element to each adjacent element is multiplied by a weighting coefficient according to the temperature of the adjacent element for each of the X direction and the Y direction, thereby identifying the position of the portion which takes the peak temperature value (peak temperature portion) within the extreme value element E33. For example, in a case where the ratio among the temperatures of the elements is T22:T23:T24:T32:T34:T42:T43:T44=2:6:4:3:6:1:3:2 as illustrated in FIG. 23, the peak temperature position within the extreme value element is point P which is located at a distance of ⅔ in the X direction and ⅔ in the Y direction. In this way, it is possible to identify the position of a defective portion with a high precision, e.g., it is possible to detect a defective portion with a resolution of 5 μm×5 μm or finer by using a radiation thermometer having a resolution of 20 μm×20 μm, for example.

Figure 24:
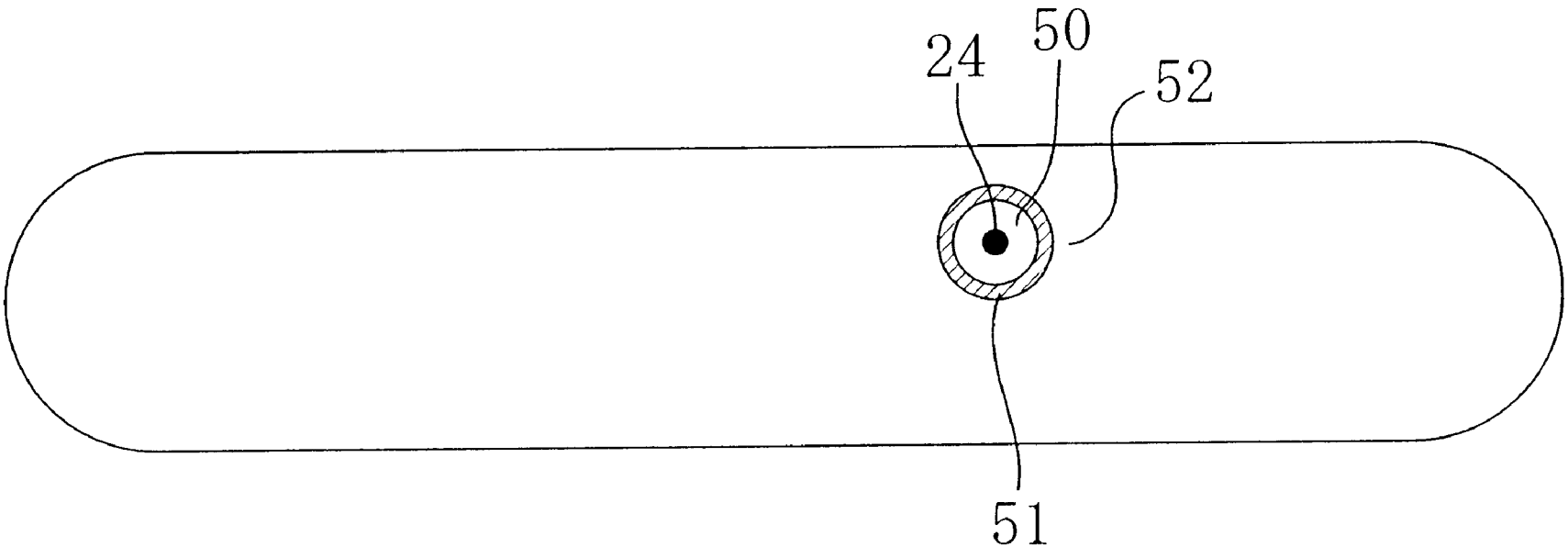
FIG. 24 is a top view of an upper electrode layer illustrating a trimmed portion.

After the defective portion detection step as described above, the portion corresponding to the defective portion 24 of the upper electrode 33 (corresponding portion) is trimmed by using laser, or the like, as illustrated in FIG. 4(*d*). As a result, the discontinuity portion 25 is formed in the upper electrode 33. Note that the trimming of the corresponding portion of the upper electrode 33 is performed for the purpose of rendering the corresponding portion inoperable as an electrode, and it is not necessarily required to trim the corresponding portion itself. For example, as illustrated in FIG. 24, the corresponding portion 50 may be separated from other portions 52 of the upper electrode 33 by trimming a surrounding portion 51 around the corresponding portion 50.

Then, as illustrated in FIG. 5(*a*), the insulative layer 22 having a thickness of 0.5 μm is formed on the surface of the upper electrode 33 by a spin-coating method, or the like, so as to cover at least the discontinuity portion 25. Note that in the present embodiment, a portion of the insulative layer 22 is used to fill up the discontinuity portion 25. In other words, an insulator is embedded in the discontinuity portion 25.

Then, as illustrated in FIG. 5(*b*), the vibration plate 23 made of chromium and having a thickness of 4 μm is formed on the surface of the insulative layer 22 by sputtering, vapor deposition, or the like. Thereafter, as illustrated in FIG. 5(*c*)., the head body 15 (second base material) which has been previously provided with the pressure chamber depressions 14, the nozzles 12, etc., is attached to the vibration plate 23 through adhesion, or the like.

Then, as illustrated in FIG. 6(*a*), the first substrate 30 is removed. Then, as illustrated in FIG. 6(*b*), the lower electrode 31 is partially removed by etching so as to leave only predetermined portions of the lower electrode 31 including portions corresponding to the pressure chambers 11. Through such a patterning operation, the plurality of separate electrodes 19 respectively corresponding to the pressure chambers 11 are formed from the lower electrode 31. Then, as illustrated in FIG. 6(*c*), the piezoelectric element 32 is partially removed by etching so as to leave only predetermined portions of the piezoelectric element 32 including portions corresponding to the pressure chambers 11, thereby forming the plurality of piezoelectric elements 18 respectively corresponding to the pressure chambers 11, in a manner similar to that for the separate electrodes 19.

Effects of the Present Embodiment

As described above, according to the present embodiment, it is possible to detect the defective portion 24 of the piezoelectric element 18 by a simple method. Moreover, a portion of the upper electrode 33 (=common electrode 17) corresponding to the defective portion 24 is removed by trimming so as to turn the portion into the discontinuity portion 25, whereby even when a normal voltage is applied between the separate electrode 19 and the common electrode 17, the applied voltage is locally absent in the defective portion 24. Therefore, even though the defective portion 24 is included in the piezoelectric element 18, no dielectric breakdown occurs, whereby the performance and quality of the ink jet head 1 do not deteriorate. Therefore, it is possible to obtain the ink jet head 1 having the thin film piezoelectric element 18 with a desirable voltage endurance.

Particularly, in the present embodiment, an insulator is embedded in the discontinuity portion 25 of the common electrode 17, whereby the application of a normal voltage through the defective portion 24 is reliably prevented by the insulator. Therefore, the voltage endurance of the piezoelectric element 18 is further improved. Moreover, ink is prevented from entering the defective portion 24.

The defective portion detection step is performed not only to identify the extreme value element for which the temperature detected by the radiation thermometer takes the extreme value, but also to identify the peak temperature position within the extreme value element by interpolating the temperature distribution among the adjacent elements, whereby it is possible to detect the defective portion with a precision exceeding the resolution of the radiation thermometer. Therefore, it is possible to detect a very small defective portion.

Embodiment 8

In an ink jet head 1*a* according to Embodiment 8, the vibration plate 23 is formed as separate portions respectively corresponding to the pressure chambers 11 as in Embodiment 2 (see FIG. 8).

The head body 15 is provided with the common electrode 17 made of platinum and having a thickness of 0.1 μm to 0.2 μm so as to cover each pressure chamber depression 14. The piezoelectric element 18 made of a thin PZT film having a thickness of 4 μm is provided on the surface of the common electrode 17, and the separate electrode 19 made of platinum and having a thickness of 0.1 μm is provided on the surface of the piezoelectric element 18 so as to correspond to each pressure chamber 11. The insulative layer 20 is formed beside and above the separate electrode 19 so as to fill up the gap between adjacent separate electrodes 19 in order to prevent short-circuiting between the separate electrodes 19. The vibration plate 23 made of chromium and having a thickness of 3 μm is formed on the surface of the insulative layer 20 so as to correspond to each pressure chamber 11.

The discontinuity portion 25 is provided in the separate electrode 19 at a position above the defective portion 24 of the piezoelectric element 18. As in Embodiment 1, etc., the discontinuity portion 25 is filled up with a portion of the insulative layer 20, and thus the defective portion 24 is a no-voltage-application portion where the applied voltage is locally absent.

The method for producing the ink jet head of the present embodiment is basically the same as that of Embodiment 2. First, as illustrated in FIG. 9(*a*), the lower electrode 31 made of platinum and having a thickness of 0.1 μm to 0.2 μm is formed by sputtering, vapor deposition, or the like, on the surface of the first substrate 30 made of magnesium oxide. Note that the lower electrode 31 is to be used, as it is, as the common electrode 17. Then, as illustrated in FIG. 9(*b*), the piezoelectric element 32 made of PZT and having a thickness of 4 μm is formed by sputtering, vapor deposition, or the like, on the surface of the lower electrode 31. Note that during this process, a defect may occur in the piezoelectric element 32. Thereafter, as illustrated in FIG. 9(*c*), the upper electrode 33 made of platinum and having a thickness of 0.1 μm is formed by sputtering, vapor deposition, or the like, on the surface of the piezoelectric element 32.

Then, the defective portion detection step is performed. The details of the defective portion detection step are as described in Embodiment 7.

Then, as illustrated in FIG. 10(*a*), the portion of the upper electrode 33 corresponding to the defective portion 24 of the piezoelectric element 32 is removed by laser trimming, or the like. As a result, the discontinuity portion 25 is formed in the upper electrode 33.

Then, as illustrated in FIG. 10(*b*), the upper electrode 33 is partially removed by etching, or the like, so as to leave only predetermined portions of the upper electrode 33. Through such a patterning operation, the plurality of separate electrodes 19 are formed. Thereafter, as illustrated in FIG. 10(*c*), the insulative layer 20 for filling up the gap between adjacent separate electrodes 19 and the discontinuity portion 25 is formed by a spin-coating method, or the like. In other words, an insulator is embedded in the gap between the separate electrodes 19 and in the discontinuity portion 25. Note that the thickness of the insulative layer 20 only needs to be equal to or greater than the thickness of the separate electrode 19 and, in the present embodiment, the thickness of the insulative layer 20 is set to be greater than the thickness of the separate electrode 19.

Then, as illustrated in FIG. 11(*a*), a vibration plate 36 made of chromium and having a thickness of 3 μm is formed by sputtering, vapor deposition, or the like, on the surface of the insulative layer 20. Thereafter, as illustrated in FIG. 11(*b*), the first substrate 30 is processed so that the pressure chambers 11 are formed at positions respectively corresponding to the separate electrodes 19. Then, as illustrated in FIG. 11(*c*), the vibration plate 36 is etched and patterned so as to leave only predetermined portions of the vibration plate 36 including portions corresponding to the separate electrodes 19. Thus, the plurality of vibration plates 23 respectively corresponding to the pressure chambers 11 are formed from the vibration plate 36.

As described above, also in Embodiment 8, a portion of the separate electrode 19 corresponding to the defective portion 24 is provided as the discontinuity portion 25, whereby no dielectric breakdown occurs in the defective portion 24 even when a normal voltage is applied between the separate electrode 19 and the common electrode 17. Moreover, since an insulator is embedded in the discontinuity portion 25, the application of the normal voltage through the defective portion 24 is reliably prevented.

Embodiment 9

Embodiment 9 is similar to Embodiment 7 or 8 except that the defective portion detection step is modified.

Figure 25:
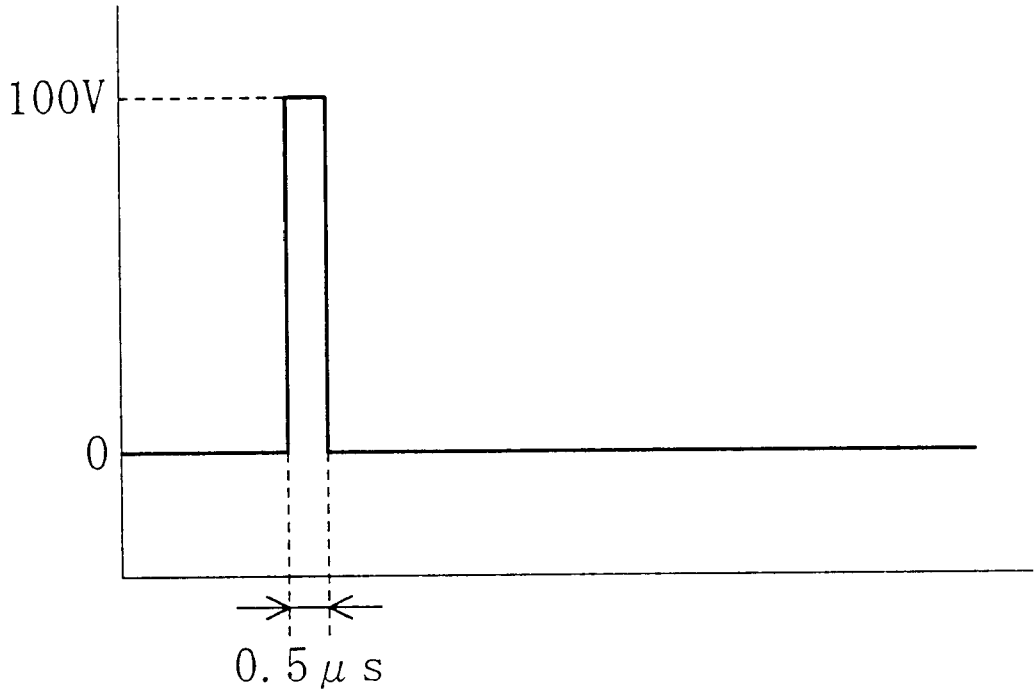
FIG. 25 is a waveform diagram illustrating a minute pulse electrode for causing minute dielectric breakdown.
Figure 26:
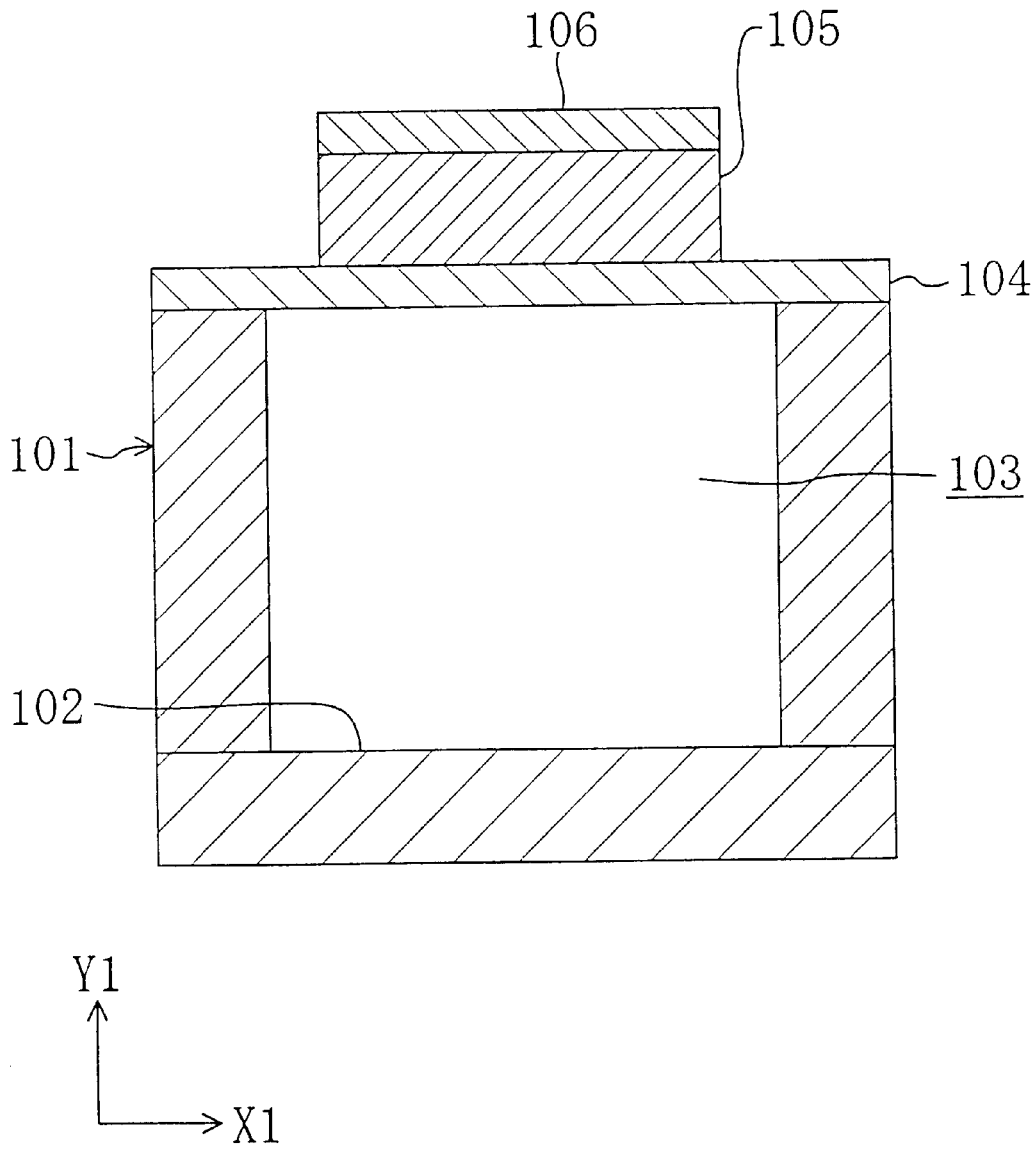
FIG. 26 is a cross-sectional view illustrating a part of a conventional ink jet head.
Figure 27:
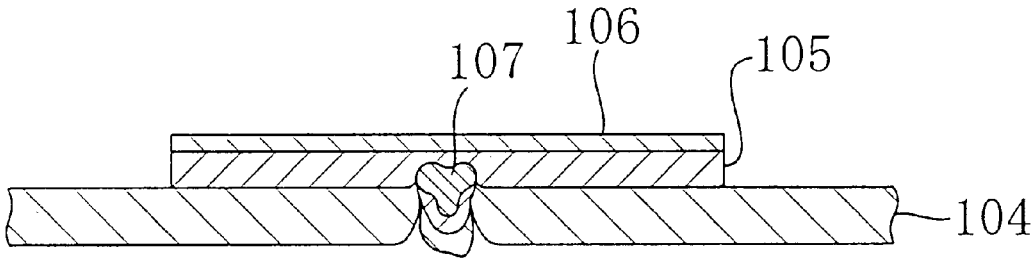
FIG. 27 is a cross-sectional view illustrating a part of a conventional ink jet head.

In the present embodiment, a minute pulse voltage that is larger than the minute pulse voltage used for temperature detection is applied between the upper electrode 33 and the lower electrode 31. For example, a rectangular pulse voltage having a voltage value of 100 V and an application duration of 0.5 $\mu$m, as illustrated in FIG. 25, is applied. Note that the current limiter is set to 1 A. Thus, a large current abruptly flows locally through the defective portion 24 of the piezoelectric element 32, thereby causing minute dielectric breakdown. The minute dielectric breakdown scatters away a portion of the upper electrode 33 above the defective portion 24, thereby removing the corresponding portion of the upper electrode 33. Thus, minute dielectric breakdown is caused at least in a portion of the upper electrode 33 corresponding to the defective portion 24 of the piezoelectric element 32.

Then, the surface condition of the upper electrode 33 is observed with a microscope, or the like, to detect the portion where minute dielectric breakdown has occurred. Thereafter, as in Embodiment 7 or 8, the portion of the upper electrode 33 corresponding to the defective portion 24 of the piezoelectric element 32 is removed by laser trimming, or the like, thereby forming the discontinuity portion 25. Note that in a case where the portion of the upper electrode 33 corresponding to the defective portion 24 has been sufficiently removed by the minute dielectric breakdown, the laser trimming, or the like, may be omitted.

Thereafter, the ink jet head 1, 1*a* is obtained as in Embodiment 7 or 8.

Thus, also in the present embodiment, it is possible to detect the defective portion 24 by a simple method, and the voltage endurance of the piezoelectric element 18 can be improved.

Embodiment 10

The insulative vibration plate 23*a* which functions also as the insulative layer 22 may be provided as in Embodiment 3 illustrated in FIG. 12 instead of separately providing the insulative layer 22 and the vibration plate 23.

Such an ink jet head may be obtained according to Embodiment 7 except for forming the insulative vibration plate 23*a* on the upper electrode 33 instead of forming the insulative layer 22 on the upper electrode 33 (insulative layer formation step) and forming the vibration plate 23 on the insulative layer 22 (vibration plate deposition step).

Alternatively, it may be obtained according to Embodiment 8 except for forming the insulative vibration plate 23*a* on the separate electrode 19 as illustrated in FIG. 13 instead of sequentially forming the insulative layer 20 and the vibration plate 36 on the separate electrode 19.

Embodiment 11

A conductive vibration plate may be used so that the vibration plate functions also as the common electrode 17 as in Embodiment 4, instead of separately providing the vibration plate and the common electrode 17. In other words, the vibration plate itself may be utilized as an electrode.

For example, such an ink jet head may be produced as follows. First, the lower electrode 31 is formed on the first substrate 30, the piezoelectric element 32 is formed on the lower electrode 31, and a conductive vibration plate is formed on the piezoelectric element 32. Thereafter, a minute pulse voltage is applied between the conductive vibration plate and the lower electrode 31 so as to detect, remove the defective portion 24 based on the temperature distribution measurement or minute dielectric breakdown. Thus, the discontinuity portion 25 is formed in the conductive vibration plate. Then, the insulative layer 22 is formed on the conductive vibration plate so as to fill up the discontinuity portion 25, and the head body 15 is attached to the insulative layer 22. Thereafter, the first substrate 30 is removed, and the lower electrode 31 and the piezoelectric element 32 are patterned.

Thus, as the vibration plate functions also as the common electrode, it is no longer necessary to separately form the vibration plate and the common electrode, whereby it is possible to downsize the head and reduce the production cost.

Alternatively, in Embodiment 8, the separate electrode 19 may be omitted, with the vibration plate functioning also as the separate electrode, as will be described below.

Specifically, first, the lower electrode 31 is formed on the first substrate 30, the piezoelectric element 32 is formed on the lower electrode 31, and a conductive vibration plate is formed on the piezoelectric element 32. Thereafter, a minute pulse voltage is applied between the conductive vibration plate and the lower electrode 31 so as to detect, remove the defective portion 24 based on the temperature distribution measurement or minute dielectric breakdown. Thus, the discontinuity portion 25 is formed. Then, the insulative layer 22 is formed on the conductive vibration plate so as to fill up the discontinuity portion 25. Thereafter, the first substrate 30 is processed so as to form the pressure chambers 11, etc. Then, the conductive vibration plate and the insulative layer 22 are patterned to form a plurality of conductive vibration plates respectively corresponding to the pressure chambers 11.

Thus, as the vibration plate functions also as the separate electrode, it is no longer necessary to separately form the vibration plate and the separate electrode, whereby it is possible to downsize the head and reduce the production cost.

INDUSTRIAL APPLICABILITY

As described above, the present invention is useful in a recording apparatus, etc., which performs an ink jet type recording operation, such as a printer, a facsimile, and a copier.

What is claimed is:

1. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing an upper electrode on the piezoelectric element;

a step of applying a predetermined voltage between the upper electrode and the lower electrode so as to cause dielectric breakdown and remove, through the dielectric breakdown, a portion of the upper electrode corresponding to the defective portion of the piezoelectric element; and a step of embedding an insulator in a removed portion of the upper electrode.

2. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing an upper electrode on the piezoelectric element;

a step of applying a predetermined voltage between the upper electrode and the lower electrode so as to cause dielectric breakdown and remove, through the dielectric breakdown, a portion of the upper electrode corresponding to the defective portion of the piezoelectric element; and a step of covering a removed portion of the upper electrode by an insulator.

3. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing an upper electrode on the piezoelectric element;

a step of applying a predetermined voltage between the upper electrode and the lower electrode so as to cause dielectric breakdown and remove, through the dielectric breakdown, a portion of the upper electrode corresponding to the defective portion of the piezoelectric element;

an insulative layer formation step of depositing an insulative layer on the upper electrode;

a vibration plate deposition step of depositing a vibration plate on the insulative layer;

a step of attaching a second base material, which has been provided with a plurality of pressure chamber depressions and nozzles, to the vibration plate so that the pressure chamber depressions are covered by the vibration plate, whereby a plurality of pressure chambers are defined by the pressure chamber depressions and the vibration plate;

a step of removing the first base material; and a step of patterning the lower electrode and the piezoelectric element so as to correspond to the plurality of pressure chambers.

4. The method for producing an ink jet head of claim 3, comprising:

a step of depositing an insulative vibration plate on the upper electrode, instead of the insulative layer formation step and the vibration plate deposition step.

5. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing an upper electrode on the piezoelectric element;

a step of applying a predetermined voltage between the upper electrode and the lower electrode so as to cause dielectric breakdown and remove, through the dielectric breakdown, a portion of the upper electrode corresponding to the defective portion of the piezoelectric element;

an insulative layer formation step of depositing an insulative layer on the upper electrode;

a vibration plate deposition step of depositing a vibration plate on the insulative layer;

a step of providing a plurality of pressure chambers and nozzles in the first base material; and a step of patterning the vibration plate so as to correspond to the plurality of pressure chambers.

6. The method for producing an ink jet head of claim 5, comprising:

a step of depositing an insulative vibration plate on the upper electrode, instead of the insulative layer formation step and the vibration plate deposition step.

7. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing an upper electrode on the piezoelectric element; and a step of applying a predetermined voltage between the upper electrode and the lower electrode so as to cause dielectric breakdown and remove, through the dielectric breakdown, a portion of the upper electrode corresponding to the defective portion of the piezoelectric element;

wherein the predetermined voltage is a pulse voltage having a larger voltage value and a shorter application duration than a normal pulse voltage, which is applied for deforming the vibration plate for discharging ink.

8. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing a conductive vibration plate on the piezoelectric element;

a dielectric breakdown step of applying a predetermined voltage between the conductive vibration plate and the lower electrode so as to cause dielectric breakdown and remove, through the dielectric breakdown, a portion of the conductive vibration plate corresponding to the defective portion of the piezoelectric element;

a step of depositing an insulative layer on the conductive vibration plate;

a step of attaching a second base material, which has been provided with a plurality of pressure chamber depressions and nozzles, to the insulative layer so that the pressure chamber depressions are covered by the insulative layer, whereby a plurality of pressure chambers are defined by the pressure chamber depressions and the insulative layer;

a step of removing the first base material; and a step of patterning the lower electrode and the piezoelectric element so as to correspond to the plurality of pressure chambers.

9. The method for producing an ink jet head of claim 8, wherein the application of the predetermined voltage in the dielectric breakdown step is performed after patterning the conductive vibration plate.

10. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, the method comprising:

a step of depositing a lower electrode on a first base material;

a step of depositing a piezoelectric element containing a defective portion on the lower electrode;

a step of depositing a conductive vibration plate on the piezoelectric element;

a dielectric breakdown step of applying a predetermined voltage between the conductive vibration plate and the lower electrode so as to cause dielectric breakdown and remove, through the dielectric breakdown, a portion of the conductive vibration plate corresponding to the defective portion of the piezoelectric element;

a step of depositing an insulative layer on the conductive vibration plate;

a step of providing a plurality of pressure chambers and nozzles in the first base material; and a step of patterning the conductive vibration plate and the insulative layer so as to correspond to the plurality of pressure chambers.

11. The method for producing an ink jet head of claim 10, wherein the application of the predetermined voltage in the dielectric breakdown step is performed after patterning the conductive vibration plate.

12. An ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink in each of the plurality of pressure chambers so as to discharge the ink through each of the nozzles, wherein:

a first electrode and a second electrode for applying a voltage through the piezoelectric element are provided respectively on opposite sides of the piezoelectric element; and a discontinuity portion is formed through dielectric breakdown in at least one of the first and second electrodes;

wherein an insulator is embedded in the discontinuity portion of the first or second electrode.

13. An ink jet head comprising:

a head body which is provided with a plurality of pressure chambers containing ink and a plurality of nozzles communicated to the plurality of pressure chambers, respectively; and a plurality of actuators each having a piezoelectric element and a vibration plate for applying a pressure on the ink -in each of the plurality of pressure chambers so as to discharge the ink through each of the nozzles, wherein:

a first electrode and a second electrode for applying a voltage through the piezoelectric element are provided respectively on opposite sides of the piezoelectric element; and a discontinuity portion is formed through dielectric breakdown in at least one of the first and second electrodes;

wherein the discontinuity portion of the first or second electrode is covered by an insulator.

14. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element, an upper electrode and a lower electrode for applying a voltage through the piezoelectric element, and a vibration plate for applying a pressure on the ink in each of the plurality of pressure chambers so as to discharge the ink through each of the nozzles, the method comprising:

a step of forming a lower electrode, a piezoelectric element, and an upper electrode;

a step of applying a predetermined voltage between the upper electrode and the lower electrode;

a step of detecting a temperature distribution of at least one of the upper electrode and the lower electrode by using a radiation thermometer; and a step of detecting a defective portion of the piezoelectric element based on the temperature distribution, wherein:

the temperature distribution is measured by the radiation thermometer for periodically detecting a temperature; and a plurality of pulse voltages are applied, as the predetermined voltage, at a cycle less than or equal to a detection cycle of the radiation thermometer.

15. The method for producing an ink jet head of claim 14, comprising:

a step of patterning at least one of the upper electrode and the lower electrode before the step of applying the predetermined voltage.

16. The method for producing an ink jet head of claim 14, wherein each of the pulse voltages is a pulse voltage having a larger voltage value and a shorter application duration than a normal pulse voltage, which is applied for discharging ink.

17. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element, an upper electrode and a lower electrode for applying a voltage through the piezoelectric element, and a vibration plate for applying a pressure on the ink in each of the plurality of pressure chambers so as to discharge the ink through each of the nozzles, the method comprising:

a step of forming a lower electrode, a piezoelectric element, containing a defective portion and an upper electrode;

a step of applying a predetermined voltage between the upper electrode and the lower electrode;

a step of detecting a temperature distribution of at least one of the upper electrode and the lower electrode by using a radiation thermometer for detecting a temperature of a plurality of elements of the upper electrode or the lower electrode, the plurality of elements each having a predetermined size;

a step of identifying as an extreme value element, for which the detected temperature is maximum or minimum among the plurality of elements, a step of identifying a peak temperature portion within the extreme value element based on a temperature distribution among the plurality of elements which are adjacent to the extreme value element, and a step of detecting the defective portion of the piezoelectric element based on the step of identifying the peak temperature portion.

18. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element, an upper electrode and a lower electrode for applying a voltage through the piezoelectric element, and a vibration plate for applying a pressure on the ink in each of the plurality of pressure chambers so as to discharge the ink through each of the nozzles, the method comprising:

a step of forming a lower electrode, a piezoelectric element containing a defective portion, and an upper electrode;

a step of applying a predetermined voltage between the upper electrode and the lower electrode;

a step of detecting a temperature distribution of at least one of the upper electrode and the lower electrode by using a radiation thermometer;

a step of detecting the defective portion of the piezoelectric element based on the temperature distribution; and a step of removing a portion of the upper electrode or the lower electrode corresponding to a surrounding portion around the defective portion.

19. The method for producing an ink jet head of claim 18, comprising:

a step of embedding an insulator in a removed portion of the upper electrode or the lower electrode.

20. The method for producing an ink jet head of claim 18, comprising:

a step of covering a removed portion of the upper electrode or the lower electrode by an insulator.

21. A method for producing an ink jet head, the ink jet head comprising:

a head body which is provided with a plurality of pressure chambers containing ink and a plurality of nozzles communicated to the plurality of pressure chambers, respectively; and a plurality of actuators each having a piezoelectric element, an upper electrode and a lower electrode for applying a voltage through the piezoelectric element, and a vibration plate for applying a pressure on the ink in each of the plurality of pressure chambers so as to discharge the ink through each of the nozzles, the method comprising:

a step of forming a lower electrode, a piezoelectric element containing a deflective portion, and an upper electrode;

a step of applying a predetermined voltage between the upper electrode and the lower electrode so as to cause dielectric breakdown;

a step of detecting a dielectric breakdown portion in the upper electrode or the lower electrode;

a step of identifying the defective portion of the piezoelectric portion based on the step of detecting the dielectric breakdown portion; and a step of removing a portion of the upper electrode or the lower electrode corresponding to a surrounding portion around the defective portion.

22. The method for producing an ink jet head of claim 21, comprising:

a step of embedding an insulator in a removed portion of the upper electrode or the lower electrode.

23. The method for producing an ink jet head of claim 21, comprising:

a step of covering a removed portion of the upper electrode or the lower electrode by an insulator.

24. The method for producing an ink jet head of claim 21, comprising:

a step of patterning at least one of the upper electrode and the lower electrode before the step of applying the predetermined voltage.

25. An ink jet head comprising:

a head body which is provided with a plurality of pressure chambers containing ink and a plurality of nozzles communicated to the plurality of pressure chambers, respectively; and a plurality of actuators each having a piezoelectric element containing a defective portion thereof and a vibration plate for applying a pressure on the ink in each of the plurality of pressure chambers so as to discharge the ink through each of the nozzles, wherein:

a first electrode and a second electrode for applying a voltage through the piezoelectric element are provided respectively on opposite sides of the piezoelectric element; and a discontinuity portion is formed in at least one of the first and second electrodes, the discontinuity portion being provided by removing a portion corresponding to a surrounding portion around the defective portion of the piezoelectric element.

26. The ink jet head of claim 25, wherein an insulator is embedded in a discontinuity portion of the first or second electrode.

27. The ink jet head of claim 25, wherein a discontinuity portion of the first or second electrode is covered by an insulator.

28. An ink jet type recording apparatus, comprising the ink jet head of any one of claims 12 to 13 and 25 to 27.

* * * * *

UNITED STATES PATENT AND TRADEMARK OFFICE

CERTIFICATE OF CORRECTION

PATENT NO. : 6,554,407 B1
DATED : April 29, 2003
INVENTOR(S) : Koji Ikeda et al.

It is certified that error appears in the above-identified patent and that said Letters Patent is hereby corrected as shown below:

Column 28,
Line 48, “ink-in” should be -- ink in --.

Signed and Sealed this

Twenty-eighth Day of October, 2003

JAMES E. ROGAN
*Director of the United States Patent and Trademark Office*